US006443547B1

(12) United States Patent
Takahashi et al.

(10) Patent No.: US 6,443,547 B1
(45) Date of Patent: Sep. 3, 2002

(54) DRIVING DEVICE FOR INKJET RECORDING APPARATUS AND INKJET RECORDING APPARATUS USING THE SAME

(75) Inventors: Kunihiro Takahashi, Fujisawa; Yoshinao Kondoh, Ebina; Akira Mihara, Sagamihara; Masashi Hiratsuka, Atsugi, all of (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/722,625

(22) Filed: Nov. 28, 2000

(30) Foreign Application Priority Data

May 8, 2000 (JP) ..... 2000-134878

(51) Int. Cl.[7] ..... B41J 29/38
(52) U.S. Cl. ..... 347/9; 347/10
(58) Field of Search ..... 347/9, 46

(56) References Cited

U.S. PATENT DOCUMENTS

| | | | | |
|---|---|---|---|---|
| 5,191,354 A | | 3/1993 | Quate | |
| 5,589,864 A | | 12/1996 | Hadimioglu | 347/46 |
| 6,116,721 A | * | 9/2000 | Higuchi et al. | 347/46 |

FOREIGN PATENT DOCUMENTS

| | | | | |
|---|---|---|---|---|
| EP | 0 273 664 | | 12/1987 | B41J/3/04 |
| JP | 62214963 A | * | 9/1987 | B41J/3/04 |
| JP | 63-166545 | | 7/1988 | B41J/3/04 |
| JP | 5-31895 | | 2/1993 | B41J/2/045 |
| JP | 5-278218 | | 10/1993 | B41J/2/045 |
| JP | 8-187853 | | 7/1996 | B41J/2/045 |
| JP | 10-199995 | | 7/1998 | H07L/21/8238 |
| JP | 2000-263780 | | 9/2000 | B41J/2/049 |

* cited by examiner

*Primary Examiner*—John Barlow
*Assistant Examiner*—Alfred Dudding
(74) *Attorney, Agent, or Firm*—Morgan, Lewis Bockius LLP

(57) ABSTRACT

The present invention provides a driving device for an inkjet recording apparatus, which uses supersonic waves to significantly save power consumption for a compact, lightweight, lower price apparatus, and provides an inkjet recording apparatus using the driving device. An LC circuit of inductance and a capacitor, and an amplitude limiting resistor are connected in series across a fixed inductance for tuning, and are connected in parallel to a degenerated equivalent circuit of a piezoelectric element oscillator. The LC circuit is served to compensate lacking complex components respecting the driving frequency when a capacitance is fluctuated by printing pattern in the degenerated equivalent circuit of simultaneously driven oscillators. By adding a LC circuit in parallel to the TANK circuit as an equivalent circuit comprised of oscillator capacitance and a fixed inductance, the fluctuated capacitance including its complex component is compensated for and the oscillators is driven at a constant frequency.

17 Claims, 21 Drawing Sheets

Case 1 TDON = 1

Case 2 TDON = 64

Case 3 TDON = 128

RF SIGNALS

COLUMN SELECTION SIGNALS

OUTPUT SIGNALS
(RF AMPLIFIER INPUT SIGNALS)

DRIVING DEVICE FOR INKJET RECORDING APPARATUS AND INKJET RECORDING APPARATUS USING THE SAME

BACKGROUND OF THE INVENTION

1. Field of the Invention

The present invention relates to a driving device and an inkjet recording apparatus, more particularly to a driving device for an inkjet recording apparatus which uses an acoustic transducer in the image recording system with liquid ink to supply alternative current signal to a piezoelectric element in order to eject liquid ink, and to an inkjet recording apparatus using the driving device.

2. Description of the Related Art

Inkjet printers, which may record images by ejecting fine particles of ink fluid so-called ink drops onto a recording medium to form dots thereon, have been in practical use. Some inkjet printers are known which make use of the operation of acoustic transducer for the device for ejecting ink drops onto a recording medium.

As an example, there is known technology described in the Japanese Patent Application Laid Open No. 5-278218 corresponding to the U.S. Pat. No. 5,191,354. An inkjet printer using the acoustic transducer may periodical perturbation on the free surface of liquid ink at any appropriate exciting frequency. If the amplitude of the perturbation pressure is more than the level of critical rising oscillation then one or more surface standing waves may be generated on the free surface of the liquid ink to cause to eject the ink drops to the recording medium. In order to generate such perturbation, the transducer may be driven by connecting it to a driver.

Also in the Japanese Patent Application Laid Open No. 8-187853 corresponding to the U.S. Pat. No. 5,589,864, a method using a piezoelectric device driven by RF signal for the transducer is disclosed. This method uses PIN diodes or varactors connected in series to the piezoelectric element to alter the impedance in case of a varactor to switch on and off the RF signal applied to control the ink drops being ejected.

In order to control the RF signal, another method in relation to the RF controller and the RF driver has been proposed by the inventor of the present invention for generating AC signal to the piezoelectric element without using any AC signal power supply (Japanese Patent Application Laid Open No. 11-72211). In this method the inductance connected in parallel to the piezoelectric element constitutes a parallel resonant circuit. A switching means supplies to the piezoelectric element alternatively the electric charge from a charge storage means and the energy from the resonant circuit to eject ink drops, without the need to ever supply AC signals, thereby resulting in the save of power consumed.

To speed up printing, a plurality of ink ejecting mechanisms, i.e., ink-drop ejectors may be provided aligned in one row to allow printing simultaneously in a plurality of positions. Nevertheless, the resulting dots with ink drops ejected by the RF signal may be dispersed. There is a need of restraining such dispersion.

A method has been proposed (Japanese Patent Application Laid Open No. 63-166545) which carries out the pulse-width modulation, amplitude modulation, frequency modulation of the RF signal to alter the size of ink drops. With this method, in other words, the appropriate use of frequency modulation and amplitude modulation as well as pulse-width modulation allows also the dispersion of the size of ink drops to be constant when a plurality of ink pools are provided.

In general, an RF power amplifier of class-A or class-AB is used for the RF controller, i.e., transducer driving circuit. In order to achieve higher speed printing by providing a plurality of ink ejectors as a printing head, a plurality of driver circuits should also be provided, one for each respective ejector. In this condition in the plural drivers the output impedance of the RF power amplifiers is usually 50 Ω, the impedance of connecting wires also is 50 Ω. In such circuit, the "Q" of the resonant circuit will become about 1 by the output impedance if the load varies, since the load is much greater than the output impedance. The resonant circuit thereby will be in a forced drive condition ($Q<1$) or the like to prevent frequency shift from occurring when the load capacitance is varied by the printing patterns.

However, it is difficult to hold constant the energy to be transferred to each respective of the printing heads in case of the fluctuation of load, provided that the constant voltage characteristics are ensured in each of printing heads. As a result, it is supposed that the dispersion of energy transferred to each of printing heads may affect to the printing quality. Thus it has been required to prevent the dispersion of energy transferred to each printing head by using frequency modulation, amplitude modulation, and pulse-width modulation as described above.

The frequency modulation, amplitude modulation, and pulse-width modulation, as well as the combination thereof, makes the driver circuit complex and costly.

In addition, inkjet printers have the problem of low efficiency of ink-drop ejection. In other words, driving current is supplied to the piezoelectric elements for producing ink drops, however only a fraction thereof is used for producing ink drops.

When considering that large amplitude is required for the signal input to the switching means for supplying the energy to the piezoelectric element in the inkjet printers, the ejecting efficiency of ink drops is not sufficient if the power consumption for generating input signal is included.

In order to control the ink ejection by turning on and off the RF signal, a switching circuit may be used for switching on and off to control AC signal. On example of AC signal control is the method disclosed in the Japanese Patent Application Laid Open No. 5-318595. In this method, as shown in FIG. 21, a diode switching circuit for controlling a required AC electric signal by applying DC signal to the diode comprises a resistor (Ra1) connected in series with an inductive element (La2) and in parallel to a capacitor (Ca1) as the driving device of inkjet printing head for recording using ink mist. In this circuit, in parallel to the printing head (HEAD), an AC element inductance (La1) is provided at the output side of diode (Da1) but a DC element capacitor is not used in order to minimize the propagation loss of AC electric signal (which is the signal output from an RF amplifier (RFA)).

Also in order to facilitate switching of an amplified RF signal, the method described in the Japanese Patent Application Laid Open No. 10-199995 discloses the RF switching provided with high-voltage CMOS diode.

In this RF switching circuit, RF switching elements such as high voltage diode and varactor are used since RF signal amplified by the radio frequency amplifier circuit has to be switched. As an example, as shown in FIG. 22, in the ink ejector mechanisms (ink-drop emitting mechanisms) arranged in one row for accelerating printing speed, a group of oscillators AcT having a plurality of columns of oscillators may be operated as a printing head. A controller CT for line control is connected at the controller side of each of the plurality of oscillators Ac1 to Acn. A group of circuits ROW having a plurality of column switching circuits are connected at the input side of the plurality of oscillators Ac1 to Acn. Each of the plurality of column switching circuit RW1 to RWn may be selectively operated by the selection signal from the column selection signal output circuit SEL. AC electric signal (signal output from the RF signal source RF and amplified by the RF amplifier RFA) is also input to each of the column switching circuits RW1 to RWn. In this circuit, RF switching elements such as high-voltage diode and varactor are required for the RF signal amplified by the RF amplifier RFA to be switched in each of respective column switching circuit RW1 to RWn.

However in this arrangement the problems of decrease of energy efficiency and degradation of isolation between columns may not be avoided, since the RF signal is switched by the RF switches after amplification, even if such RF switching elements as a high-voltage diode or a varactor are used.

SUMMARY OF THE INVENTION

The present invention has been made in view of the above circumstances and has an object to overcome the above problems and to provide a driving device for inkjet recording apparatus, which uses supersonic waves to significantly save the power consumption, and to allow compact, lightweight, lower price apparatus.

In addition to the above, another object of the present invention is to provide a driving device for inkjet recording apparatus, which may switch on and off at higher speed and lower consumption power for the input signal of small amplitude.

In addition, still another object of the present invention is to provide a driving device for inkjet recording apparatus, which may lower the voltage applied to the RF switches, allowing high frequency amplifier to become more compact without using high voltage elements for the RF switches.

In an inkjet recording apparatus having a plurality of ink drops ejecting mechanisms arranged in a row as a row bank to simultaneously print in a plurality of positions, as printing pattern always changes, the load in the view point of driving device always changes. In the apparatus using supersonic waves for ejecting ink drops, since it has capacitive load, it has been difficult to supply power constantly with respect to the varying capacitance. In the inkjet printing apparatus of the Prior Art uses frequency modulation to keep constant ejection power when the load is changed by modulating frequency based on the load changed due to the printing pattern. On the other hand, a modulation in the driver with transistor switches has been proposed by the inventor of the present invention (Japanese Patent Application Laid Open No. 11-72211).

To simultaneously print in a plurality of positions, power should be effectively supplied to the oscillators such as piezoelectric transducer element. In general high frequency signal is practically used for power supplying to one or more piezoelectric elements. However, high frequency power supplying to one or more piezoelectric elements requires switching with high-voltage element, and may result in some decrease of energy efficiency due to the attenuation of amplified signals, or some degradation of isolation between switched elements.

The first aspect of the present invention is a driving device for an inkjet recording apparatus, wherein AC signals is supplied to a plurality of piezoelectric elements for ejecting liquid ink from at least one piezoelectric element to form an image. The driving device comprises switching means for switching the AC signals for ejecting liquid ink by using selection signals for selecting piezoelectric elements to be supplied with the AC signals to start ejection of the ink, and amplifier means connected to the piezoelectric elements for amplifying the AC signals, wherein the switching means and the amplifier means are connected in series.

In accordance with the first aspect of the present invention, AC signals may be supplied to a plurality of piezoelectric elements while at least one piezoelectric element ejects liquid ink. Among these plurality of piezoelectric elements, some piezoelectric elements may be selected with the selection signal to eject liquid ink, the AC signals may be switched thereto by the switching means so as to eject liquid ink, i.e., so as to be transferred to the selected piezoelectric elements. The AC signals driving the piezoelectric elements are switched first, and then amplified by the amplifier means. The switching means and amplifier means are serially connected to start ejecting liquid ink from the appropriate piezoelectric elements in response to the AC signals applied. In this configuration power may be supplied directly from the amplifier means to the piezoelectric elements so as to prevent amplified signals from attenuating due to the switching by high-voltage switching elements, to avoid the decrease of energy efficiency and the degradation of isolation. By power supplying directly from the amplifier means to the piezoelectric elements, the distance from the piezoelectric elements to the driver means supplying power thereto may be shorter.

Preferably, in an inkjet recording apparatus in which energy for injecting ink from at least one piezoelectric element is supplied for ejecting liquid ink, the driving device for applying AC signals to the piezoelectric elements is disposed such that the distance between the piezoelectric elements and the driving device becomes at or less than 20 times of the wavelength $\lambda$ of driving frequency of the piezoelectric elements. In this manner the insertion loss of signal transmission lines and reflection of signal may be minimized, allowing the power to the driving device to be transferred to the piezoelectric elements at the maximum efficiency. Also in this manner the power consumption may be significantly decreased as compared with the coaxial transmission line connection in the Prior Art, as well as the distance between the driving device (especially the amplifier means) and the piezoelectric elements may be shorter, allowing the deployment of more preferable shield which may minimize unnecessary radiation of unwanted electromagnetic waves.

When using a piezoelectric element row bank that constitutes of a plurality of piezoelectric elements, if a plurality of such row banks are placed in parallel in the direction perpendicular to the direction of the row bank, a two dimensional matrix of a plurality of piezoelectric elements may be achieved. The present invention may be preferably applied to such two dimensional matrix of a plurality of piezoelectric elements.

More specifically, a driving device for an inkjet recording apparatus which supplies AC signals to a plurality of piezoelectric elements to eject liquid ink from at least one piezoelectric element to form an image, may comprise: a group of piezoelectric elements including a plurality of piezoelectric element row banks having the plurality of piezoelectric elements arranged in a row for providing a matrix of the plurality of piezoelectric elements; a plurality of switching means, each provided for a respective corresponding row bank of piezoelectric elements, for switching the AC signals including image signals of the image in order to inject liquid ink from the piezoelectric elements; and a plurality of amplifier means each connected to a respective corresponding row bank of piezoelectric elements and each provided between the group of piezoelectric elements and the switching means, for amplifying the AC signals.

The switching means as described above may switch between the row banks of piezoelectric elements having a plurality of piezoelectric elements arranged in a row. In this manner AC signals may be switched first, in the switching means, then supplied to the row banks of piezoelectric elements. By amplifying thus switched and supplied AC signal with the amplifier means, the amplified signals may be directly supplied to the row bank of piezoelectric elements without the attenuation of amplified signal due to the switching, the decrease of energy efficiency, or the degradation of isolation.

If a matrix of a plurality of piezoelectric elements is assumed to be constituted of a plurality of row banks, then the energy (for example, signal voltage) applied to the switching means such as an RF switcher for selecting between row banks of a plurality of piezoelectric elements arranged in a row will become higher. In contrast, in accordance with the present invention, switching means, such as RF switching arrays in typical application for selecting between row banks, may be inserted between the source of AC signal such as an RF signal supply and the amplifier means such as a radio frequency amplifier. This allows the energy applied to the switching means (for example signal voltage) to be lowered, to facilitate selection of a plurality of piezoelectric elements arranged in a row by a row bank signal.

When selecting a row bank of piezoelectric elements for supplying power thereto, it is preferable to select at least one piezoelectric element belonging to the row bank of piezoelectric elements. Accordingly it is preferable for the driving device to further provide driver means for enabling driving of at least one piezoelectric element belonging to the row bank of piezoelectric elements in order to eject liquid ink from at least that one piezoelectric element. In this arrangement AC signals may be switched by the switching means prior to supplying to the row bank of piezoelectric elements, then amplified by the amplifier means to enable at least one piezoelectric element belonging to the row bank of piezoelectric elements so as to facilitate driving of at least one piezoelectric element. Although in this description the elements arranged in a row is referred to as a "row" bank, the bank of elements in a row may be referred to as either row or column.

In order to drive piezoelectric elements, both the AC signals and select signals are needed. The switching means may comprise power transistors for amplifying the AC signals, and switching transistors connected in parallel to the power transistors to switch the power transistors between enabled and disabled status. In other words, in the selecting means which may supply AC signals to the amplifier means in response to the selection signal, power transistors may amplify the AC signal, and the power transistors may be enabled or disabled according to the selection signal for selecting a bank of piezoelectric elements. In this manner the switching of AC signal by the selection signal will be easily performed.

More specifically, in the switching means an output node is connected to the drain terminals of P-channel MOS transistor and N-channel MOS transistor, the source terminal of the P-channel MOS transistor is connected to the power supply, the source of the N-channel MOS transistor is grounded to the ground, the gate terminal of the N-channel MOS transistor is connected to the source of AC signal, and the gate of the P-channel MOS transistor is applied with bank (row or column) selection signal to turn on and off the AC signal appeared at the output node.

This power transistor has preferably its output lower than the input threshold of the following amplifier stage in order to suppress erroneous operation. To achieve this, the switching means may incorporate a setting means connected to the input terminal of the power transistor for setting the voltage of AC signal input. By setting the voltage of AC signals, the amplitude of output may be set accordingly. For example, when an amplifier of switching type is used for the high frequency amplifier, erroneous operation (injection error) by the amplifier circuit of the bank of piezoelectric elements currently not selected may be prevented by using MOS transistors to adjust the "off" output voltage of the switching means lower than the threshold level of the amplifier means such as radio frequency amplifier switching circuit.

In this setting means a resistor is provided between the gate of N-channel MOS transistor in the switching means and the ground, and between the gate and the power terminal. The value of resistor may be chosen such that the "off" output from the switching means may not exceed the input threshold voltage of the amplifier means.

In such configuration as described above, high-voltage switch is useless in the switching means. The source of signals such as RF signal supply for supplying the AC signals is allowed to output low voltage output signal such as TTL- or CMOS-level by means of PLL (Phase Locked Loop) or the like. The selection of column banks in a matrix may be performed by switching the AC signals (RF signals) by the selection signal to feed only to the appropriate column banks of piezoelectric elements. The AC signal (RF signals) input to the selected column bank may be amplified by the amplifier means for that column bank (for example high frequency amplifier-switcher circuit) to apply directly to the piezoelectric element(s). Here at least one piezoelectric element to eject liquid ink is selected by the piezoelectric elements in the row bank selected by the driver means (for example row bank selector circuit) controlled based on the printing pattern.

More specifically, an inkjet printer having a plurality of piezoelectric elements for injecting ink arranged in a matrix, a source of AC signals (RF signal source) for applying to the piezoelectric elements, a column bank switching circuit (RF switch) for switching on and off the AC signals, radio frequency amplifier circuits of the number equal to the column banks, and a row selector circuit for row control based on the printing pattern, may incorporate a column selector circuit for turning on and off the AC signals between the AC signal supply (the source of RF signals) and the radio frequency amplifier.

Also, an inkjet printer having a plurality of piezoelectric elements for injecting ink arranged in a matrix, a source of AC signals (RF signal source) for applying to the piezoelectric elements, a row bank switching circuit (RF switch) for switching on and off the AC signals, radio frequency amplifier circuits of the number equal to the row banks, and a selector circuit for column control based on the printing pattern, may incorporate a row selector circuit for, turning on and off the AC signals between the AC signal supply (the source of RF signals) and the radio frequency amplifier.

Any switching type amplifier may be served for the radio frequency amplifier circuit. The transistors configured fur the switching means may also be served for the row selector circuit or the column selector circuit. In this case the parameter of N- and P-channel MOS transistors (on resistance and the like) may be selected such that the "off" output from the row selector or column selector circuit will not exceed to the input threshold voltage of the radio frequency amplifier switching circuit. More specifically, resistors are provided between the gate of N-channel MOS transistor of the row or column selector circuit and the ground and between the gate and the power supply, the value of the resistors being determined such that the off output of the row or column selector circuit may not exceed the input threshold of the radio frequency amplifying switching circuit.

In a matching scheme with an inductance inserted in parallel to the oscillator capacitance or in a drive using the resonance for yielding the maximum power transferred to the oscillator, when the load varies the frequency may be shifted if the inductance for the resonance circuit is fixed.

In order to overcome this problem, the second aspect of the present invention is a driving device for an inkjet recording apparatus, wherein the frequency shift is suppressed by the printing pattern. For example, an arrangement having an inductance for the resonance with respect to the loads driven simultaneously, and a series CR circuit in parallel to the parallel LC equivalent circuit (TANK circuit).

Specifically, the second aspect of the present invention supplies AC signals to a plurality of piezoelectric elements while injects liquid ink from at least one piezoelectric element to form an image, comprises an inductance connected in parallel to the plurality of piezoelectric elements, switching control means for controlling injection of the liquid ink by switching on and off the connection between the plurality of piezoelectric elements and the AC signals, and an adjusting means for holding resonant frequency to a predetermined value by controlling the resonant frequency in response to the changes of capacitive load of the plurality of piezoelectric elements.

The second aspect of the present invention may supply AC signals to a plurality of piezoelectric elements while injects liquid ink from at least one piezoelectric element. An inductance is connected to these plurality of piezoelectric elements. The inductance and the piezoelectric element may form a resonant circuit. When AC signals are supplied to the piezoelectric elements, the resonant circuit will accumulate an amount of energy.

The switching control means controls the injection of liquid ink by switching on and off the connection between a plurality of piezoelectric elements and the AC signals in response to input signals. When the signals are switched on or off by a switching element such as transistors, if the switching is on, the AC signals will be supplied to the piezoelectric elements. At this time some energy will be saved in the resonant circuit. If the switching goes off, the energy accumulated in the resonant circuit will be supplied to the piezoelectric elements. The energy from AC signals and the energy from the resonant circuit will be alternatively supplied to the piezoelectric elements to oscillate the liquid ink to start ejecting the ink.

In this case, if the number of driven elements in the plurality of piezoelectric elements is changed, the capacitive load will be altered accordingly. The adjusting means adjusts the resonant frequency in response to the amount of shift of the capacitive load of the plurality of piezoelectric elements to control the resonant frequency to a predetermined value. This allows some energy to be supplied at a predetermined fixed resonant frequency by the adjustment of the adjusting means if the capacitive load is varied due to the changes of the number driven of the plurality of piezoelectric elements.

The input signals may use the printing pattern to form an image. By using the printing pattern (drive signal indicating the position of the piezoelectric elements to be driven corresponding to the image data) for the input signals, liquid ink may be driven in a manner approximately uniform at every piezoelectric element, and printed dots also may be approximately uniform each other, resulting in an image of higher quality.

For the adjusting means, an LC circuit of an inductor and a capacitor connected in parallel may be used. The inkjet recording apparatus of the present invention incorporates an LC circuit comprised of the capacitance of piezoelectric elements and a fixed inductance. An additional LC circuit is connected in parallel to the LC circuit of the capacitance of piezoelectric elements and a fixed inductance to compensate for the fluctuating load, including its complex component, so as to regulate to a constant frequency. The LC circuit additionally connected in parallel supports the complex component that may lack with respect to the driving frequency when the capacitance fluctuates according to the printing pattern. Consequently a constant frequency may be regulated.

A limiting resistor may be further serially connected to the above additional LC circuit connected to the LC circuit comprised of the capacitance of piezoelectric elements and a fixed inductance. By using this, the amount of charges in the added LC circuit may be maintained to a constant level, while on the other hand the limiting resistor may always keep constant the amplitude of voltage of the transferred signal at the time of fluctuating capacitance.

When an additional LC circuit is added in parallel to the LC circuit comprised of the capacitance of piezoelectric elements and a fixed inductance, these two inductances may be degenerated to only one inductance because they are connected in parallel. Therefore, an RC circuit of a resistor and a capacitor serially connected may be used for the adjusting means. This means that since the inductance in the additional LC circuit and the fixed inductance may be degenerated to only one inductance, when degenerated, the additional LC circuit may be thought to be merely a C. If the limiting resistor is serially connected to this degenerated LC circuit, the resulting circuit will be equivalent to an RC circuit, which may safely omit an inductance without decrease of performance.

In order to preferably regulate the varying capacitive load in response to the printing pattern, some voltage controlling elements such as variable capacitors and variable inductors may be used. When using a variable capacitative element, that is, when the adjusting means includes a voltage controlling element, the capacitive fluctuation due to the printing pattern may be compensated for and a constant load to the sender may be achieved by controlling the voltage controlling element with an element controller means in response to the fluctuating capacitive load of the plurality of piezoelectric elements.

One variable capacitative element is, for example, a voltage controlled variable capacitative element by the voltage regulated by a variable capacitance diode and the like. When using a variable capacitor, that is, when the adjusting means includes a variable capacitative element, the adjusting means may vary its capacitance in response to the fluctuation of capacitive load of the plurality of piezoelectric elements. As can be seen, the voltage regulated variable capacitative element may compensate for the fluctuating capacitance due to the printing pattern and regulate a constant load to the sender circuit.

If the signal applied to the voltage regulated variable capacitative element has an amplitude larger than the variable capacitance controlling voltage, then the range of varying capacitance will be narrowed, and the regulation of capacitance to a target value may or may not be difficult. In such a case, a voltage regulated variable capacitative element such as variable capacitance diode may be provided to each of respective positive and negative voltages sides to connect the one's cathode with the other's anode to apply both positive and negative voltages. In this manner the sum of capacitances of variable capacitance diodes i.e., voltage controlled variable capacitative elements may be held to a constant value for AC signals, allowing capacitance to be electrically controlled.

Another example of voltage controlling element is a variable inductance element. When the adjusting means comprises a variable inductance element, it can vary its capacitance in response to the fluctuation of capacitive load in the plurality of piezoelectric elements. As can be appreciated, by completing fluctuating capacitance due to the printing pattern with a variable inductance element the frequency may be always held to a constant value. In other words, when the capacitance varies in response to the fluctuation of capacitive load in a plurality of piezoelectric elements, if the inductance value corresponding to the fluctuation may be determined, the variable inductance element may compensate for it. This allows fluctuating inductance due to the printing pattern to be varied according to the fluctuating capacitance to always hold a constant frequency.

In the second aspect of the present invention, the adjusting means may further provide a power detector means for detecting the supplied power of the supplied current or supplied voltage to the piezoelectric elements, and a power controller means for regulating the resonant frequency in response to the detected power.

The controllable value for controlling the voltage controlling element, i.e., the voltage for controlling the voltage controlled variable capacitative elements or the voltage for controlling the voltage controlled variable inductance element can be calculated in advance based on the printing pattern, the magnitude of load being the product of the number of printing dots and the capacitance of each respective oscillator. When the supplier provides constant voltage or constant current characteristics, the controllable value may be determined by using the relationships of the printing pattern proportional to the supplied power, i.e., supplied voltage or current from the supplier to detect the applied power, i.e., current or voltage.

The second aspect of the present invention may be used in combination with the first driving device in accordance with the present invention. When used in combination, the combination may be achieved by coordinating the controller switching means included in the second driving device to the switching means included in the first driving device to constitute a driving device having further inductances and adjusting means.

The third aspect of the present invention is a driving device for inkjet recording apparatus for achieving the above objects, which supplies AC signals to a plurality of piezoelectric elements to eject liquid ink from at least one piezoelectric element to form an image, may comprise: inductances connected in parallel to the plurality of piezoelectric elements to form a resonant circuit, first switching means for controlling the connection between the plurality of piezoelectric elements and the AC signals, resonant circuits connected in parallel to the first switching means, second switching means for controlling supply of the AC signals to the resonant circuits, and controller means for controlling injection of the liquid ink by causing the second switching means to be iteratively repeated to be turned on; and off in response to the signal input thereto.

The third aspect of the present invention may supply AC signals to a plurality of piezoelectric elements while injecting liquid ink from at least one piezoelectric element. Each of the plurality of piezoelectric elements is connected in parallel to an inductance to form a resonant circuit. When AC signals are fed to the piezoelectric elements, energy will be accumulated in the resonant circuits.

The controlling means controls the injection of liquid ink by switching on and off the connection between the plural piezoelectric elements and the AC signals in response to the input signals. In other words, when the first switching means switches on or off, if on then the AC signals will be fed to the piezoelectric element. At the same time some energy of signals may be accumulated in the resonant circuit. When the first switching means is off, the energy saved in the resonant circuit will be supplied to the piezoelectric element. The first switching means may be connected in parallel to a resonant circuit, to which AC signals from the second switching means will be supplied. When the second switching means operates to switching on or off in response to the input signal such as printing pattern and the like, if switching on, then some energy will be accumulated into the resonant circuit. Also if the second switching means is turned off, then the energy saved in the resonant circuit will be supplied to the first switching means. Therefore AC signals and energy from the resonant circuit will be alternatively fed to the first switching means to start oscillating and injecting liquid ink.

For example, the inkjet recording apparatus to which the present invention is applicable may supply AC signals to piezoelectric elements acoustically coupled to liquid ink (generate acoustic signals) to inject ink. The piezoelectric elements may be connected to a multi-stage switching means for controlling the connection between the input signals and the piezoelectric elements. The multi-stage switching means may be capacitive coupled to the conductance.

Between stages of respective switching means, an inductance and a resistance are connected between the output node of a switching means and the ground. The inductance and resistance forms a parallel resonance circuit with respect to the composite capacitance of the output capacitance of preceding switching means with the input capacitance of succeeding capacitance.

The value of inductance may be set according to the composite capacitance and the frequency of input signals. The input signals are assumed to be burst pulses in the range between 100 and 200 MHz. It should be noted that a sinusoidal burst wave may be used instead.

The value of resistance may be set so as to settle the sharpness of the parallel resonant circuit "Q" to be a desired value (for example, preferably 1 to 2). This is for the wave shaping of rising and falling edges of the RF signal part in the burst signals.

When using high speed, small input capacitance, and small output switching means having the parallel resonant circuit as described above for the first stage, if the initial input signal is of small amplitude, for example burst pulses at TTL level of 0 to 5V, the first stage may supply sinusoidal waves of larger amplitude oscillating from 0V to both positive and negative sides.

In addition, by applying the same technique, i.e., driving succeeding stage of switching means having larger output and larger input capacitance, the piezoelectric elements may ultimately be driven by the signals of desired amplitude.

More specifically, the resonant circuit and the first switching means may be capacitive-coupled with a capacitor or the like.

The resonant circuit may also comprise an inductance for resonance, which may constitute a parallel resonant circuit having the composite capacitance of the output capacitance of second switching means connected to the input of resonant inductance with the input capacitance of first switching means connected to the output of resonant inductance, and the composite impedance of the output impedance of second switching means connected to the input of resonant inductance with the input impedance of first switching means connected to the output of resonant inductance.

This parallel resonant circuit may be tuned to the input signals. The resonant circuit may be of an inductance element and a resistor. The resistor may form a parallel resonant circuit comprised of the inductance element, and the composite capacitance of the output capacitance of second switching means connected to the input of the inductance element with the input capacitance of first switching means connected to the output of the inductance element.

The resistor value R in this case may be preferably set to be in the range $\pi \cdot F \cdot L < R < 2\pi \cdot F \cdot L$, where L is the value of the inductance element, F is the resonant frequency of the parallel resonant circuit.

The input signals may preferably be low voltage signals within a predetermined range (so-called TTL level) and may preferably be a sort of pulse signals.

The third aspect the present invention may be combined with at least one of the first and second driving devices. When combining it with the first driving device in accordance with the present invention, the combination may be achieved by coordinating switching means included in the first driving device in accordance with the present invention with the first switching means and the second switching means of the third driving device in accordance with the present invention to further provide inductances and controlling means for the driving device. When combining with the second driving device in accordance with the present invention, the combination may be achieved by coordinating controller switching means included in the second driving device in accordance with the present invention with the first switching means and second switching means of the third driving device to further provide inductances and controlling means for the driving device.

BRIEF DESCRIPTION OF THE DRAWINGS

The accompanying drawings, which are incorporated in and constitute a part of this specification, illustrate an embodiment of the present invention and, together with the description, serve to explain the objects, advantages and principles of the present invention. In the drawings.

DETAILED DESCRIPTION OF THE PREFERRED EMBODIMENTS

A detailed description of one preferred embodiment embodying the present invention will now be given referring to the accompanying drawings. This embodiment is an image forming apparatus for multi-colors to which the present invention may be applied.

(Image Forming Apparatus)

Figure 2:
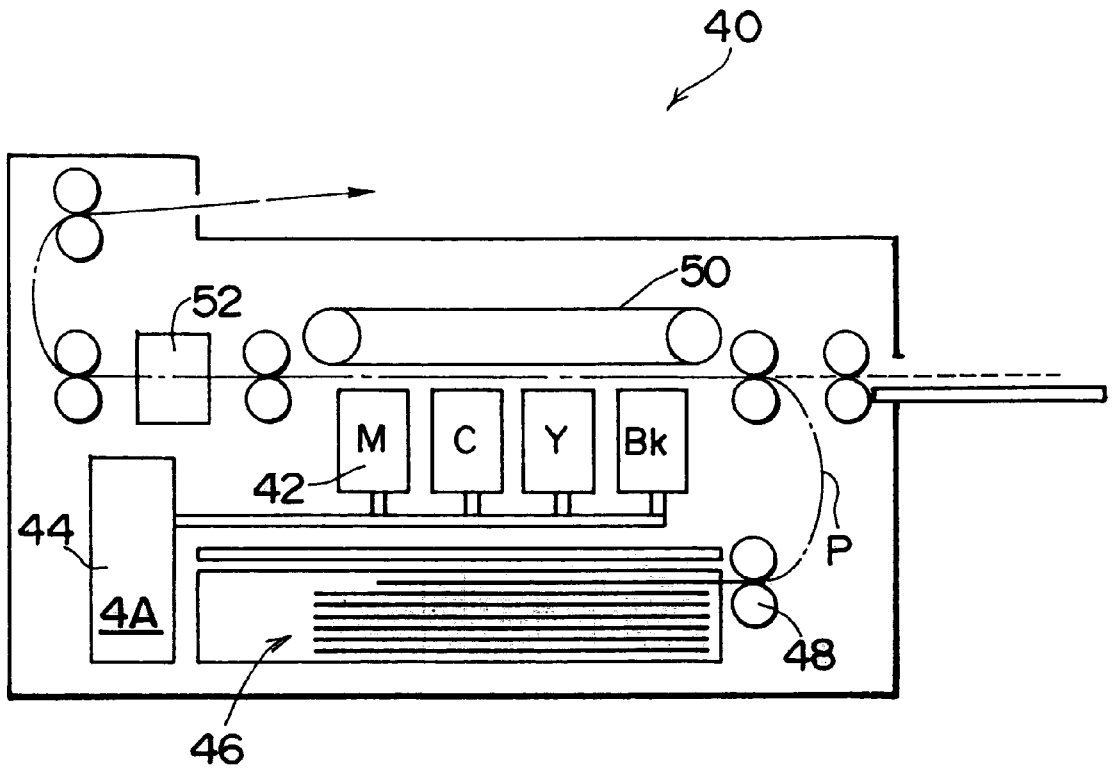
FIG. 2 is a schematic cross-sectional view of the structure of an embodiment of multi-colors image forming apparatus to which the present invention may be applied.

Now referring to FIG. 2, there is shown a schematic cross-sectional view of the structure of an embodiment of multi-colors image forming apparatus to which the present invention may be applied.

An image forming apparatus 40 incorporates four (4) recording heads 42 in which colored particles of Magenta (M), Cyan (C), Yellow (Y) and Black (Bk) are stored. The four recording heads communicate to the reservoir 44 storing liquid 4A, from which reservoir liquid 4A may be supplied as needed. Each of the recording heads 42 comprises a color particle supplier, a particle thin film generator, and a pressure generator. Each of the recording heads 42 injects liquid drops with colored particles of each color attached to the surface thereof, in response to the image signal supplied, toward a recording medium P carried by a carrier mechanism 48 from a paper stock tray 46. Drops ejected adhere to the desired position on the recording medium P to form a multi-colored image thereon.

A recording medium is carried by a transporter 50 to the fusing station 52, where the recording medium passes between a press roll built-in to the fuser and the nip of a heater roll heated to approximately 150 degrees Celsius. At this time the image is fixed on the recording medium P by the heat and pressure applied by a press roll and the heater roll.

The fusing station 52 may not be limited to the structure as described above and other heat fusing type fusers than a heater roll type includes a fusing station formed by a heater pad and a film member, and a fuser in which a contact-less strong light source is closely positioned to the medium. In addition, an effective fuser appropriate to the characteristics of colored particles used may be selected for substantive fixation onto the recording medium. For example, when encapsulated colored particles are used including fixative, a press roll may be disposed so as to break capsules with pressure to fix on a recording medium.

(Ink Injector)

The recording heads 42 are formed with an ink injector mechanism for injecting liquid drops toward a recording medium P to form a multi-colored image on the recording medium P. Now referring to FIG. 3, there is shown a schematic diagram of an ink injector 20 of an ink injecting mechanism and a driver circuit 30 corresponding to the driving device in accordance with the present invention.

Figure 3:
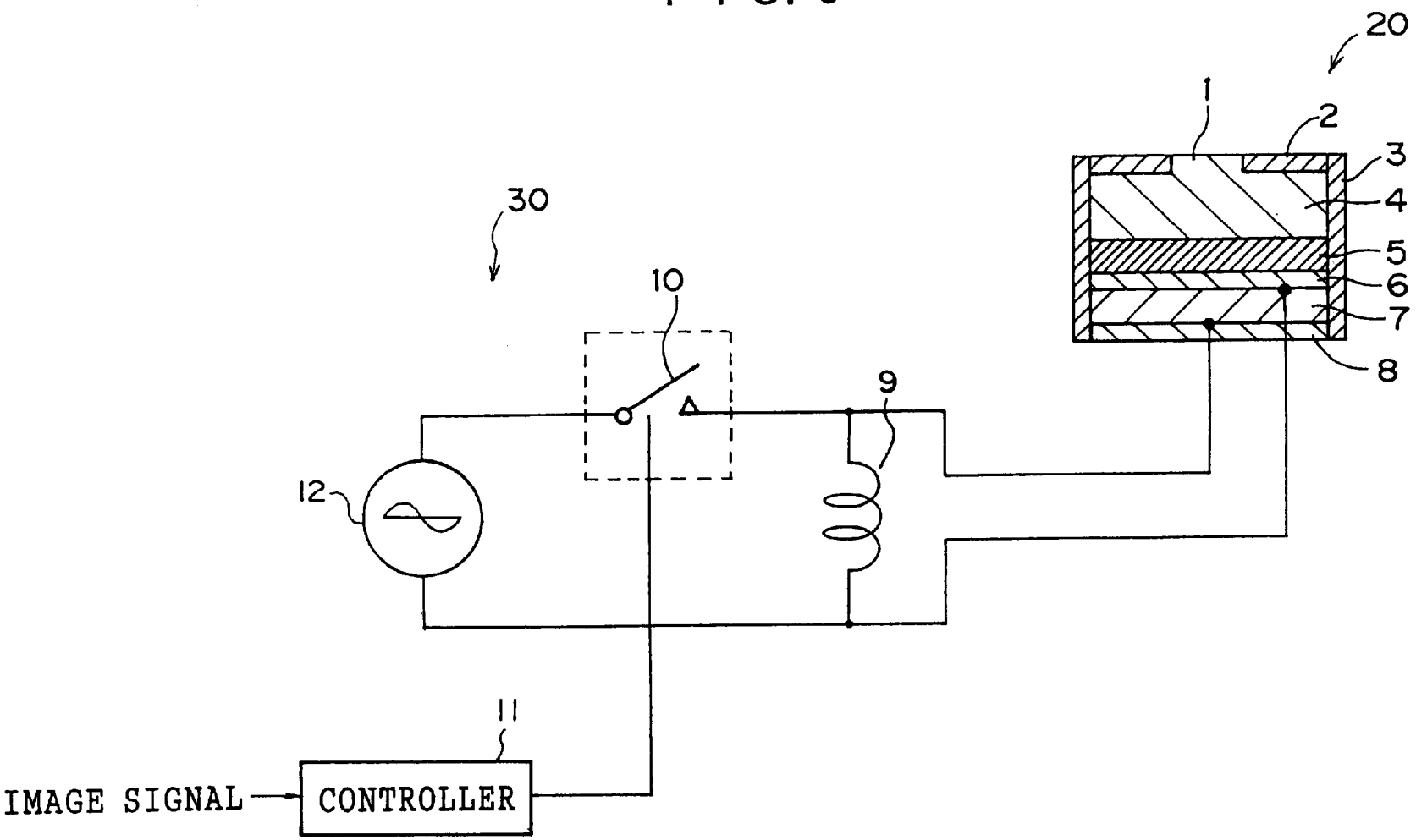
FIG. 3 is a schematic diagram of an ink injector 20 of an ink injecting mechanism and a driver circuit 30 corresponding to the driving device in accordance with the present invention.

As can be seen from FIG. 3, the ink injector 20 of the ink injection mechanism according to the present preferred embodiment has side walls 3 surrounding an ink reservoir 4 filled with liquid ink. The ink injector 20 includes at the top thereof an ink retainer (head) 2 with an ink injector opening 1. At the bottom of the ink retainer 2 a piezoelectric element 7 is mounted, sandwiched by an upper electrode 6 and a lower electrode 8, and acoustically connected to the ink in the retainer 2. On the upper electrode 6 within the ink reservoir 4, a lens 5 such as Fresnel lens is mounted for acoustically converging the supersonic waves generated by the piezoelectric element 7 toward the injector 1. The ink injector mechanism in accordance with the present preferred embodiment of the present invention may be contained in an acoustic inkjet printer, in which printer a recording medium P may be set at the direction of injected ink from the ink injector opening 1.

One output node of a piezoelectric element driver circuit 12 comprised of an RF-AMP is connected through a switcher 10 to the lower electrode 8, the other output node of the piezoelectric element driver circuit 12 is connected to the upper electrode 6. A controller 11 is connected to the switcher 10.

The switcher 10 and controller 11 may correspond to the controller switching means in accordance with the present invention.

The ink injector in accordance with the present embodiment has an inductance 9 connected to both the upper electrode 6 and lower electrode 8 in parallel to the piezoelectric element 7, disposed at the position nearest to the piezoelectric element 7 and piezoelectric element driver circuit 12. The switcher 10 is mounted at a position approaching to the piezoelectric element 7 and piezoelectric element driver circuit 12.

The approaching position here means the distance between the piezoelectric element and the driver circuit which applies AC signals to the piezoelectric element, and the switcher 10 should be preferably mounted at the distance at or less than $20\lambda$ of the wavelength of driving frequency for the piezoelectric element. In this manner the insertion loss and the reflection of the transmission line will be minimized, while at the same time the power from the driving circuit may be transferred to the piezoelectric element at the maximum possible efficiency. This configuration may also significantly decrease the power consumption, and the distance between the driver circuit and the piezoelectric element, when compared with the conventional connection with a coaxial transmission line, allowing the unwanted radiation of unnecessary electromagnetic waves to be minimized.

Figure 4:
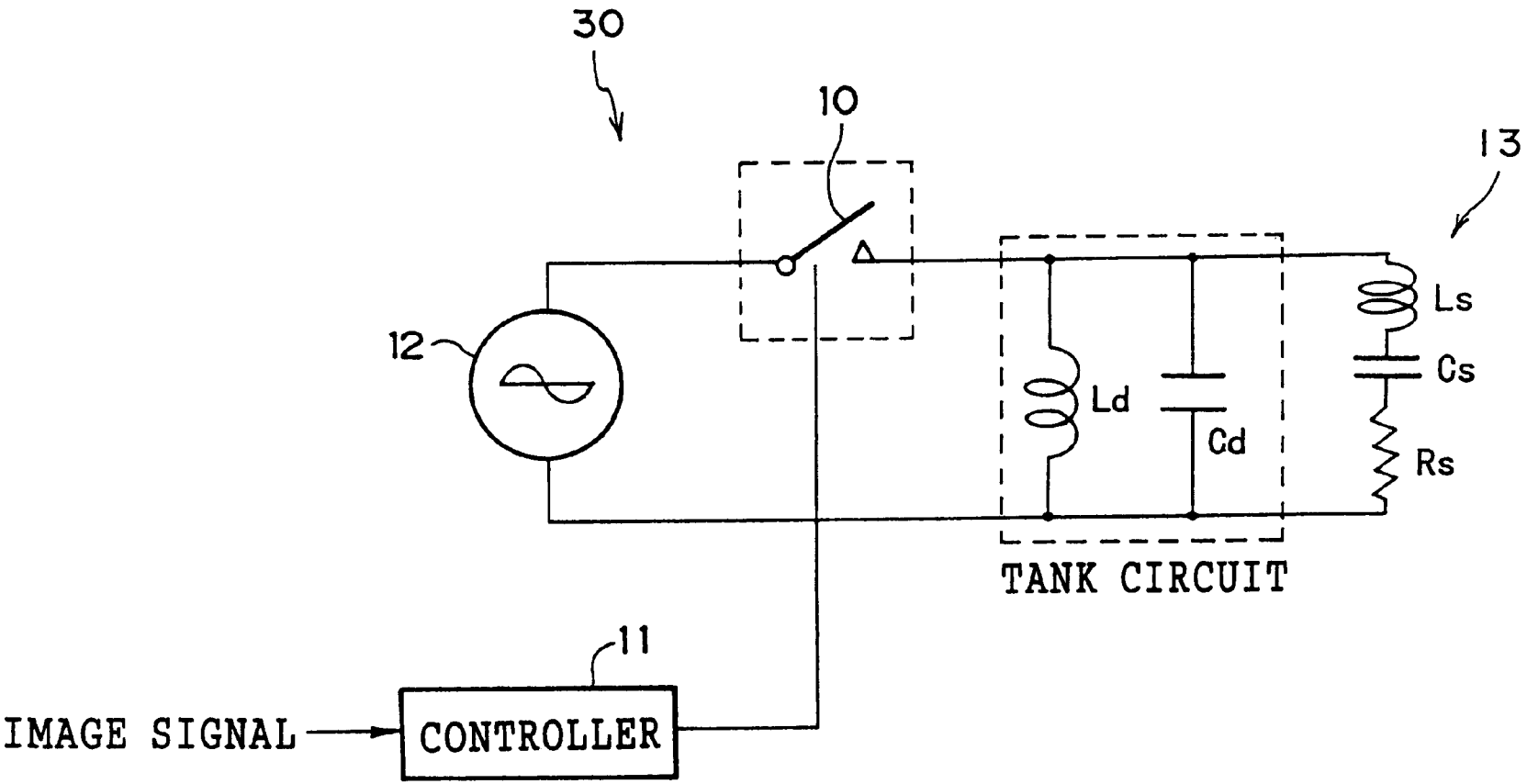
FIG. 4 is an equivalent circuit of the section from the driver circuit 30 to the piezoelectric element.

Now referring to FIG. 4, there is shown an equivalent circuit of the section from the driver circuit 30 to the piezoelectric element. The piezoelectric element 7 may be expressed in an equivalent circuit, to which a series resonant circuit 13 having a capacitor Cd, an inductance Ls, a capacitor Cs, and a resistor Rs are connected in parallel. The capacitor Cd and the inductance Ld may form a parallel resonant circuit, called TANK circuit. Since this TANK circuit is capable of storing energy, once some energy is accumulated therein, when the switcher 10 is open (goes to off), the stored energy (electric power) will be transferred (oscillated) between the capacitor Cd and the inductance Ld at a predefined frequency given by $f=1/(2\pi\sqrt{Cd\cdot Ld})$, where self-resonant frequency determined by the Cd and Ld may be set so as to be equal to the frequency of AC signals supplied from the piezoelectric element driver circuit 12.

In this circuit the presence of limiting elements of the inductance Ls, capacitor Cs, and resistor Rs causes energy to attenuate (damping oscillation) when the energy displaces. The behavior of damping oscillation may be determined by the value of capacitor Cd, inductance Ls, capacitor Cs, and resistor Rs. If the capacitive ratio ($=Cd/Cs$) is more than 1 AND the sharpness Q ($=1/(2\pi fCs\cdot Rs)$) of the serial resonant circuit 11 of Ls, Cs, and Rs is more than 1, then the energy will damping-oscillate one cycle or more.

The damping oscillation of energy between the capacitor Cd and inductance Ld causes electrical power to flow in the resistor Rs (i.e., AC signals to be supplied) to oscillate the piezoelectric element 7 to produce supersonic waves. In other words the energy stored in the TANK circuit is used for the production of supersonic waves. As a result the piezoelectric element 7 may be oscillated and supersonic waves may be generated by the energy stored in the TANK circuit, without feeding driving current from the piezoelectric element driver circuit 12. In this embodiment, the power consumption of the circuit is saved by controlling the on-off transition of switcher 10 to alternatively switch the power from the piezoelectric element driver circuit 12 and that from the TANK circuit to supply to the piezoelectric element 7 and making use of dumping oscillation of stored energy between the capacitor Cd and inductance Ld.

Figure 22:
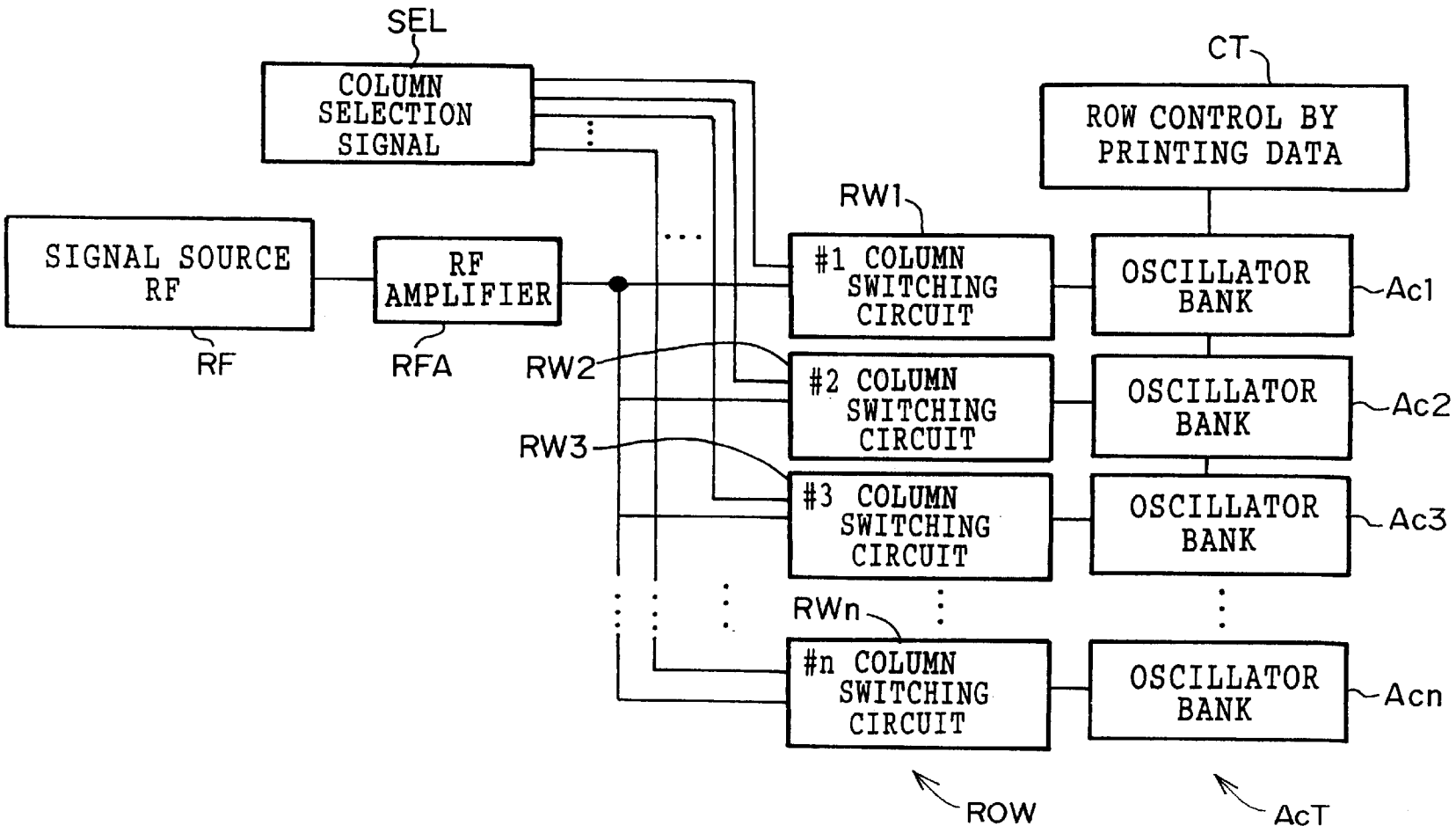
FIG. 22 PRIOR ART
FIG. 22 is a schematic diagram illustrating a conventional driver circuit by the Prior Art.

In the present embodiment, in order to accelerate printing speed, a plurality of mechanisms for ink injection, i.e., for ink blowout is provided to allow printing of simultaneous plural dots. Referring to an exemplary embodiment as shown in FIG. 22, RF signals generated in the RF signal generator RF will be input, via an amplifier RFA, to column switching circuits RW1 to RWn. Column switching circuits RW1 to RWn passes RF signals when selected by the row selector signal SEL to apply RF signals to one of oscillator groups Ac1 to Acn. In this configuration, in combination with the row selected by the rowselector circuit CT controlled by the printing data, a piezoelectric element 7 for injecting ink is selected to print an image corresponding to the printing data.

In the present embodiment, a printing head having a number of piezoelectric element 7 disposed in a matrix configuration of vertically 8 rows by horizontally 128 columns capable of forming multiple dots (8×128 elements) is used. It should be noted that this head may be either configured for each color, or configured such that one column is served for one color.

In the following description one exemplary piezoelectric element (oscillator) will be described in detail otherwise specified. A number of piezoelectric elements disposed in a matrix configuration in columns and rows and capable of forming a corresponding number of dots may refer to as the piezoelectric element groups in accordance with the present invention, and one bank of piezoelectric elements in a row may be referred to as the column bank of piezoelectric elements in accordance with the present invention. One set of elements aligned in a row may be sometimes referred to as a column of oscillators. A column of piezoelectric elements is comprised of a plurality of elements connected in parallel, each of which is connected to the row selector circuit Row Selector Circuit CT. A piezoelectric element 7 is determined by the element belonging to a column that is selected by the row selector circuit CT.

If the load fluctuates in response to, for example, a printing pattern, it is readily anticipated that the printing quality may be affected thereby because the energy transferred to each head varies since it is difficult to keep the energy transferred to each head constant. Thus the fluctuation of the energy transferred to respective head have to be sufficiently suppressed. In the foregoing description, although an equivalent circuit including a piezoelectric element has been described, the inductance may be considered to be degenerated to one unit since in a row of piezoelectric elements including a plurality of piezoelectric elements (referred to as a column of oscillators, hereinafter) elements are connected in parallel. The number of oscillators used for printing may be varied according to the printing pattern, causing the fluctuation of load, thus the dispersed energy supplied.

In order to overcome this problem, a preferred embodiment for keeping the load constant will be described below in detail, especially on the section around the piezoelectric element 7 and driver circuit 30 of the injector, which comprises the basic configuration similar to the above ink injectors.

First Embodiment

This preferred embodiment has been made for accomplishing the compensation of fluctuating load due to the printing pattern and the constant load from the sender circuit side, by using a voltage controlled variable capacitor.

Figure 5:
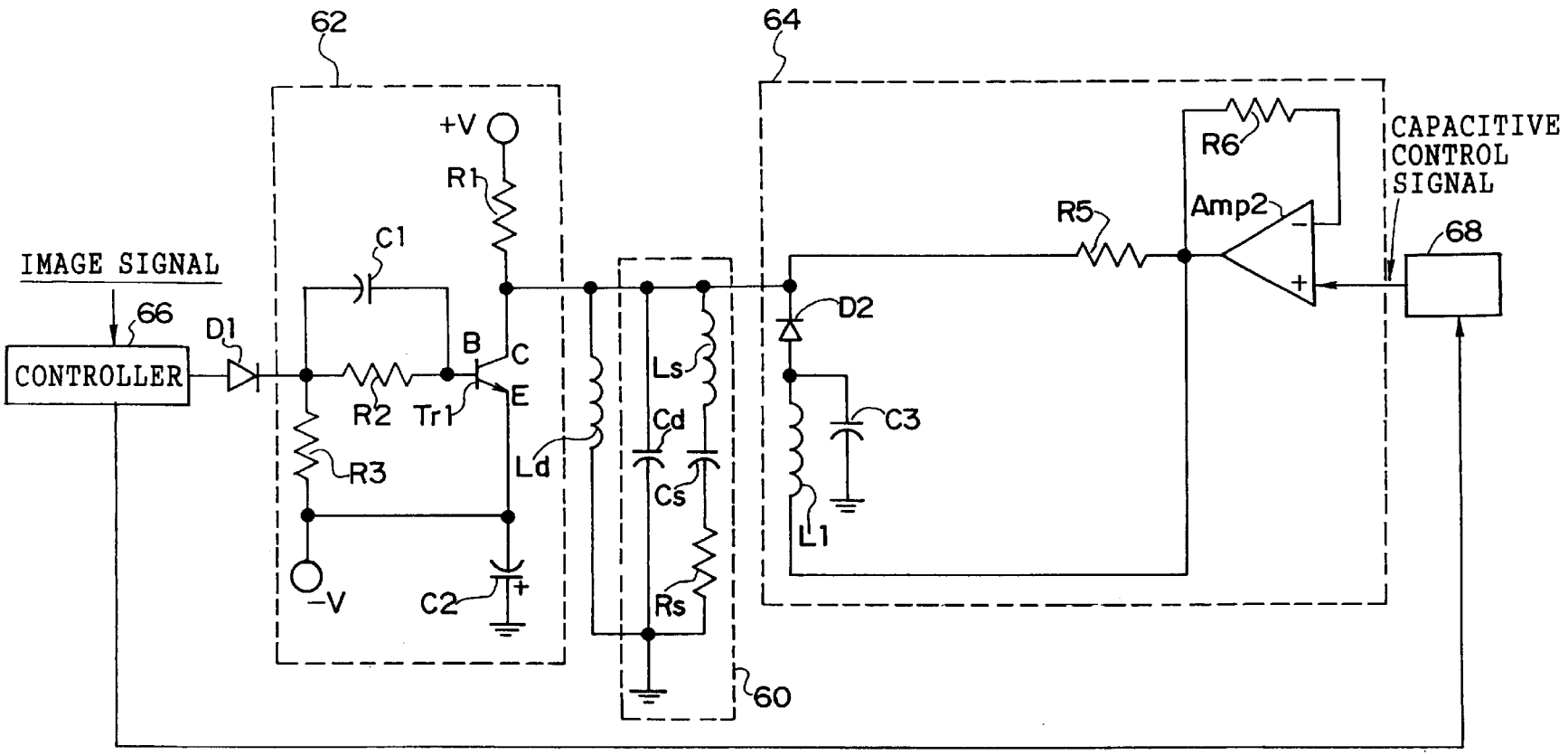
FIG. 5 is a schematic diagram illustrating a piezoelectric element 7 and its driver and peripheral circuits in an ink injector in accordance with the first embodiment of the present invention, in which a variable capacitative element regulates the fluctuated capacitance due to the printing pattern.

Now referring to FIG. 5, there is shown an equivalent electric circuit of a piezoelectric element 7 for injecting ink drops. As have been described in the above description, the piezoelectric element 7 may be expressed as an equivalent circuit 60 in which series resonant circuits 13 each having a capacitor Cd, an inductance Ls, a capacitor Cs, and a resistor Rs are connected in parallel (referred to as a degenerated equivalent circuit 60 of oscillator, hereinbelow). In the equivalent circuit, Cd designates to the oscillator capacitance, and the Rs to the acoustic equivalent resistance.

This degenerated equivalent circuit 60 has a fixed inductance Ld connected in parallel for tuning. The degenerated equivalent circuit 60 of the oscillator and the inductance Ld are grounded at one end, and are connected through an oscillator driver 62 to a controller 66 at the other end. The controller 66 corresponds to the controller 11 of FIG. 3, which outputs on-signals in response to the image signals for injecting ink.

The oscillator driver 62 comprises a transistor Tr1. The collector of transistor Tr1 is connected to the other ends of the degenerated equivalent circuit 60 for the oscillator and of the inductance Ld as well as is connected to the positive power supply (+V) through a resistor R1. The emitter of transistor Tr1 is grounded through a capacitor C2 and is connected to the negative power (−V). The negative power (−V) is further connected to the base of transistor Tr1 through a series connection of resistor R2 and resistor R3. A capacitor C1 is connected in parallel to the resistor R2. The other node of the resistor R2 connected to the base of transistor Tr1 is connected to the cathode of a diode D1.

The other ends of both the degenerated equivalent circuit 60 for the oscillator and the inductance Ld are connected to a signal processor 68 via a voltage application circuit for capacitive control 64. The signal processor 68 has a controller 66 connected for output signals for capacitance control. In other words, the signal processor 68 generates electric signals by determining the capacitive value to be added in accordance with the number of oscillators simultaneously driven.

The voltage application circuit for capacitive control 64 comprises an amplifier Amp2. The positive input of the amplifier Amp2 is connected to the output of the signal processor 68, while the negative input thereof is connected to the output of the same through a resistor R6. The output of the amplifier Amp2 is connected to the cathode of a diode D2 through a resistor R5 and to the anode of the anode of the diode D2 through an inductance L1. The cathode of the diode D2 is connected to the other ends of the degenerated equivalent circuit 60 for the oscillator and the inductance Ld. Since the diode D2 is served as a voltage controlled variable capacitive element, a variable capacitance diode may be used. The junction of this diode D2 and the inductance L1 is grounded through a capacitor C3.

The diode D2 served as a voltage controlled variable capacitative element is connected as described above to the inductance Ld for tuning frequency and the degenerated equivalent circuit 60 for the oscillator in parallel, for AC signals.

The voltage application circuit for capacitive control 64 corresponds to the adjusting means in accordance with the present invention, and the diode D2 corresponds to the voltage controlling element in accordance with the present invention. In this configuration, the fluctuated capacitive load is derived from the controller 66 (the printing pattern), corresponding to the number of oscillators to be driven. The voltage application circuit for capacitive control 64 may operate as the element controlling means in accordance with the present invention.

Now the function of the present preferred embodiment will be described below in detail. The signals from the controller 66 are in the form of so-called tone burst, which is used to toggle on and off RF signals at given timings, and is corresponding to the number of oscillators included in the column bank of oscillators. The signals may or may not be in the form of sinusoids oscillating around the ground level to both positive and negative sides, or in the form of pulses oscillating to one of either positive or negative side. When using pulses, a compact, low power consumption RF signal generator circuit may be achieved if a combination of crystal oscillator and a PLL (Phase Locked Loop) is used.

The signals from the controller 66 is input to the oscillator driver 62 through the diode D1, then passed to the base of the transistor Tr1 through the capacitor C1. The resistors R2 and R3 are served for the regulation of appropriate input bias level of the transistor Tr1. The emitter of the transistor Tr1 is applied with the negative power supply (−V), and the collector thereof is applied with the positive power (+V). Accordingly the tone bursts switched in high speed are fed to the piezoelectric element 7.

More specifically, the capacitor Cd which is a piezoelectric element 7 designated in the degenerated equivalent circuit 60, is connected in parallel to the series resonant circuit 13 comprised of a inductance Ls, a capacitor Cs, and a resistor Rs, the capacitor Cd and the inductance Ld forms in this configuration a parallel resonant circuit so-called a TANK circuit. The TANK circuit, which once stores energy therein, may transit (oscillate) the stored energy (electric power) between the capacitor Cd and the inductance Ld at the predefined frequency ($=1/(2\pi\sqrt{Cd \cdot Ld})$), triggered by the toggled off transistor Tr1. The self-resonant frequency determined by the Cd and Ld is set so as to be equivalent to the AC signal frequency from the oscillator driver 62.

In this configuration, the inductance Ls, capacitor Cs, resistor Rs are present as limiting factors, the energy transition will be progressively reduced (dumping oscillation) at the time of transition of the energy. The dumping oscillation may be determined by the values of capacitor Cd, inductance Ls, capacitor Cs, and resistor Rs. If the capacitive ratio ($=Cd/Cs$) is more than 1 and the sharpness Q ($=1/(2\pi fCs \cdot Rs)$) of the serial resonant circuit 11 of Ls, Cs, and Rs is more than 1, then the energy will damping-oscillate one cycle or more.

The damping oscillation of energy between the capacitor Cd and inductance Ld causes electrical power to flow in the resistor Rs (i.e., AC signals to be supplied) to oscillate the piezoelectric element 7 to produce supersonic waves. In other words the energy stored in the TANK circuit is used for the production of supersonic waves. As a result the piezoelectric element 7 may be oscillated and supersonic waves may be generated by the energy stored in the TANK circuit, without feeding driving current from the piezoelectric element driver circuit 12.

The energy transferred to the printing head may be dispersed due to the varying printing pattern. This means that the varying printing pattern fluctuates the capacitive load. To compensate for such fluctuation, in the present preferred embodiment, capacitance control signals are output from the signal processor 68 in response to the signal incoming from the controller 66. More specifically the capacitance control signals are generated in response to the capacitance value to be added corresponding to the number of simultaneously driven oscillators. The resistor R6 is for regulating amplification ratio of the amplifier. The resistor R5 is for regulating appropriate bias level input into the oscillator. The capacitance regulating signal is amplified by the amplifier Amp2 to supply voltage to the cathode of diode D2 and to the oscillator so as to compensate for the fluctuating capacitance due to the printing pattern.

In this manner, the applied voltage may be regulated in the voltage application circuit for capacitive control 64 by the capacitance regulating signal output from the signal processor 68 such that the diode D2, a voltage controlled variable capacitative element, becomes more appropriate capacitance. The voltage controlled variable capacitative element (diode D2) may thereby compensate for the fluctuation of capacitance due to the printing pattern to maintain a constant level of load, such that the energy transferred to each of printing heads may be kept constant even if the load is fluctuated by the printing pattern, allowing the improved printing quality.

Second Embodiment

In the first embodiment as described above, the range of varying capacitance may be limited so as to become difficult to regulate the capacitance to a desired target value in case in which the signal applied to the voltage controlled variable capacitative element has larger amplitude than the variable capacitance controlling voltage. The second embodiment is made for readily regulating the capacitance to a desired target value in case in which the signal applied to the voltage controlled variable capacitative element has larger amplitude than the variable capacitance controlling voltage. The present embodiment has the identical configuration as the preceding embodiment, the similar members are designated to the identical reference numbers and the detailed description of the parts already described in the preceding embodiment will be omitted. In the second embodiment, what is different from the preceding first embodiment is the structure inside the voltage application circuit for capacitive control.

Figure 6:
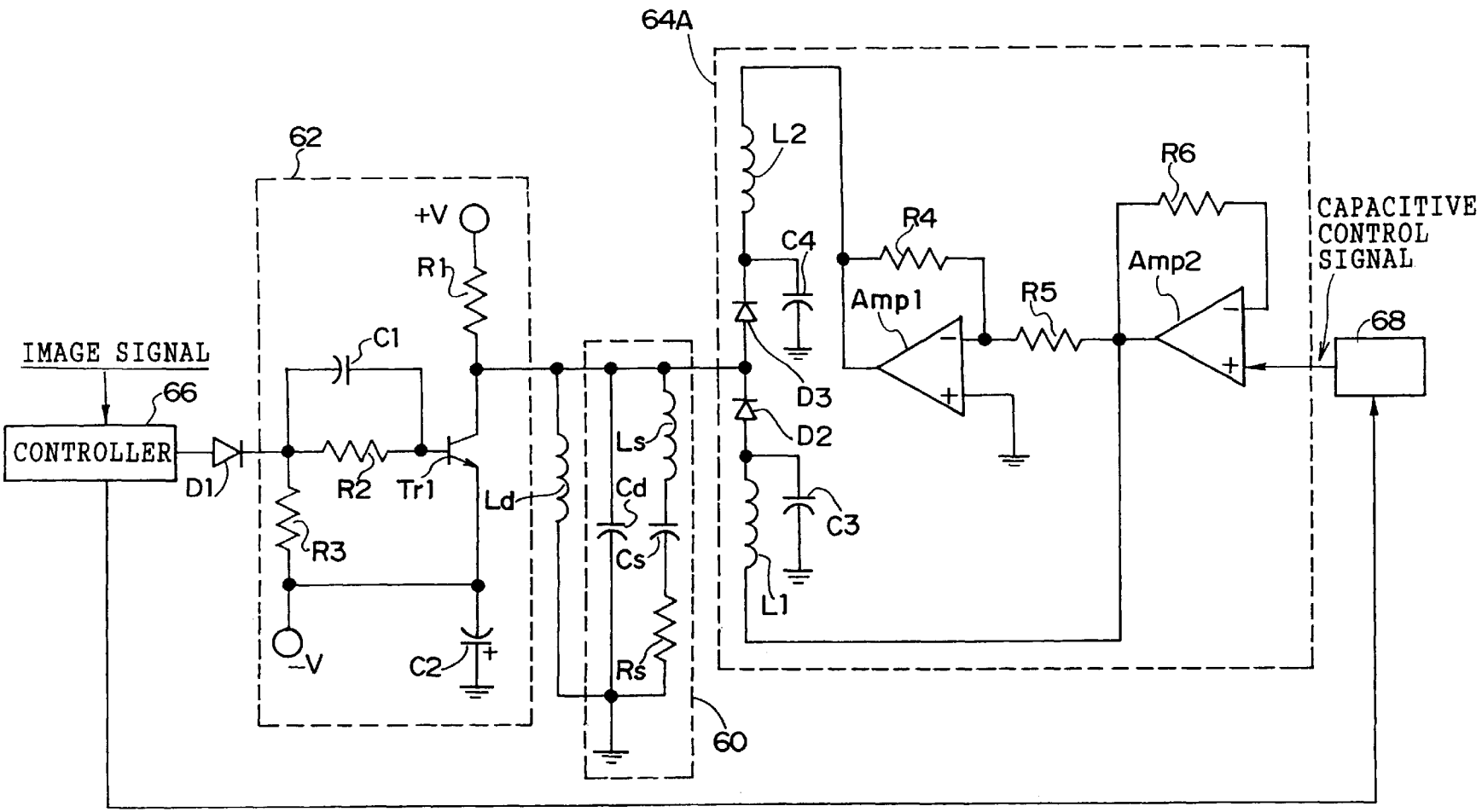
FIG. 6 is a schematic diagram illustrating a piezoelectric element 7 and its driver and peripheral circuits in an ink injector in accordance with the second embodiment of the present invention, in which a variable capacitive element regulates the fluctuated capacitance due to the printing pattern.

Now referring to FIG. 6, in this embodiment, the other ends of the degenerated equivalent circuit 60 of the oscillator and the inductance Ld are connected together to, the signal processor 68 via a voltage application circuit for capacitive control 64A. The voltage application circuit for capacitive control 64A comprises an amplifier Amp1 and amplifier Amp2. The positive input of the amplifier Amp2 is connected to the output of the signal processor 68, and the negative input thereof is connected to the output of the amplifier Amp2 through a resistor R6. The output of the amplifier Amp2 is connected to the negative input of the amplifier Amp1 through the resistor R5. The negative input of the amplifier Amp1 is connected to the output of the amplifier Amp1 through an resistor R4, while the positive input is grounded. The output of the amplifier Amp1 is connected to the other ends of the degenerated equivalent circuit 60 for the oscillator and the inductance Ld through an inductance L2 and a diode D3. The junction between the inductance L2 and the diode D3 is grounded through a capacitor C4.

The junction of the anode of the diode D3 with the other ends of the degenerated equivalent circuit 60 for the oscillator and the inductance Ld is connected to the cathode of the diode D2, to which junction the output of the amplifier Amp2 is also connected through the diode D2 and the inductance L1. In this embodiment, the diode D2 and diode D3 are served for voltage regulated variable capacitance elements. Therefore variable capacitance diodes may be used for the diode D2 and D3.

As can be appreciated from the above description, the present embodiment comprises an inverted circuit for generating positive and negative voltages as the voltage application circuit for capacitive control 64A.

Now the function of the present preferred embodiment will be described below in detail. In the present embodiment, the degenerated equivalent circuit 60 for simultaneously driven oscillators is connected to the junction between the cathode of variable capacitance diode D2 and the anode of diode D3, diodes D2 and D3 are applied with positive and negative voltage, respectively. Since the voltage amplitude with respect to the signals of the degenerated equivalent circuit 60 for the simultaneously driven oscillators is usually alternative current, the voltage applied to the diode D3 will become smaller and the voltage applied to the diode D2 will become larger if the positive signal amplitude is larger. On the other hand, if the negative signal amplitude is larger then the voltage applied to the diode D3 will be smaller and the voltage applied to the diode D3 will be larger.

More specifically, in case in which positive signal amplitude is large and the voltage applied to the diode D3 which is a voltage controlled variable capacitative element, becomes smaller, the voltage applied to the diode D2 which is another voltage controlled variable capacitative element will be increased. If the capacitance of one diode becomes smaller than the capacitance of the other will be increased accordingly, resulting in a constant sum of capacitances of the diode D2 and diode D3 for AC signals.

In accordance with the present embodiment therefore the capacitance may be electrically regulated to an appropriate level if the voltage amplitude of the signal of the degenerated equivalent circuit 60 for simultaneously driven oscillators.

Third Embodiment

The third embodiment of the present invention is to keep the frequency constant by varying the inductance in response to the printing pattern along with the fluctuation of capacitance, by using a voltage regulated variable inductance circuit. The present embodiment has the identical structure to the preceding embodiments, the similar members are designated to the identical reference numbers and the detailed description of the parts already described in the preceding embodiments will be omitted.

Figure 7:
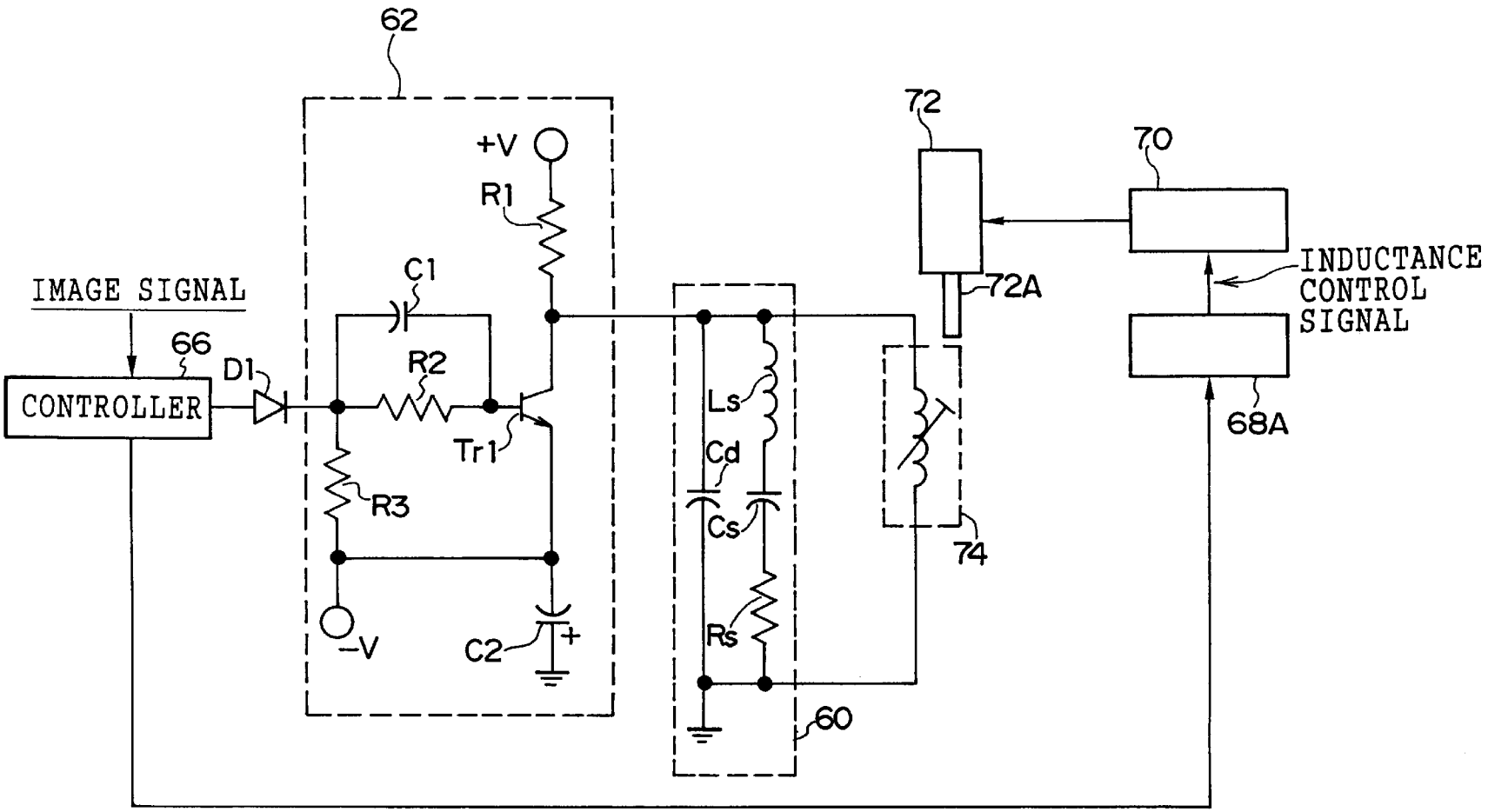
FIG. 7 is a schematic diagram illustrating a piezoelectric element 7 and its driver and peripheral circuits in an ink injector in accordance with the third embodiment of the present invention, in which a variable inductance element regulates the fluctuated capacitance due to the printing pattern.

Now referring to FIG. 7, it should be noted that in this embodiment a variable inductance 74 capable to vary the inductance value for tuning is connected instead of the fixed inductance Ld for tuning connected in parallel to the degenerated equivalent circuit 60 for oscillator in the preceding embodiments.

Also in the present embodiment another signal processor 68A for output variable inductance regulating signal is connected to the controller 66. The signal processor 68A is used for determining the inductance value based on the number of simultaneously driven oscillators and for generating electrical signals according thereto. The output of the signal processor 68A is connected to a solenoid 72 having a core 72A through a solenoid driver circuit 70.

The variable inductance 74 and the solenoid 72 are coupled each to other so as to determine the inductance of the variable inductance 74 in response to the movement of the core 72A driven by the solenoid 72.

The variable inductance 74 in this embodiment corresponds to the voltage controlling element of the present invention, the solenoid driver circuit 70 and solenoid 72 correspond to the adjusting means of the present invention. In this configuration, the fluctuating capacitive load is derived from the controller 66 (printing pattern), corresponding to the number of driven oscillators. The voltage application circuit for capacitive control 64 is served also as the element controller means of the present invention.

Now the function of the present preferred embodiment will be described below in detail. In this embodiment the number of driven oscillators is determined by the signal processor 68A in response to the signals from the controller 66 to determine the inductance value for yielding a predetermined constant tuned frequency. The signal processor 68A outputs to the solenoid driver circuit 70 the variable inductance control signal corresponding to thus determined inductance value. The variable inductance control signal is a signal corresponding to the inductance value of variable inductance 74 determined by the movement of the core 72A of the solenoid 72, which signal corresponds to the quantity of movement of the core 72A.

Thus the core 72A is moved by deriving the driven frequency from the printing pattern to determine in signal processor 68A the inductance value for holding a predetermined constant frequency to generate the variable inductance control signal (core moving signal) to drive the solenoid 72 with the solenoid driver circuit 70. The inductance of the variable inductance 74 is altered by the moved position of the core 72A so as to control the inductance to an appropriate value.

As can be appreciated from the foregoing description, the frequency may always be kept constant by varying the inductance in response to the printing pattern, along with the fluctuation of the capacitance.

It should be noted that although in the present embodiment the variable inductance is varied by mechanically moving the position of core, a similar effect may be achieved by using a variable inductance since the complex number corresponding to wL may remain among a number of complex numbers in a filter configuration such as the distance between the inductance and a metallic body such as iron, and the electronic load in an equalizer.

Fourth Embodiment

The fourth embodiment is made for maintaining a constant frequency by compensating for the fluctuated capacitance including its complex component by adding an additional LC circuit in parallel to the LC circuit comprised of the oscillator capacitance and a fixed inductance as an equivalent circuit. The present embodiment has the identical configuration as the preceding embodiments, the similar members are designated to the identical reference numbers and the detailed description of the parts already described in the preceding embodiments will be omitted.

Figure 1:
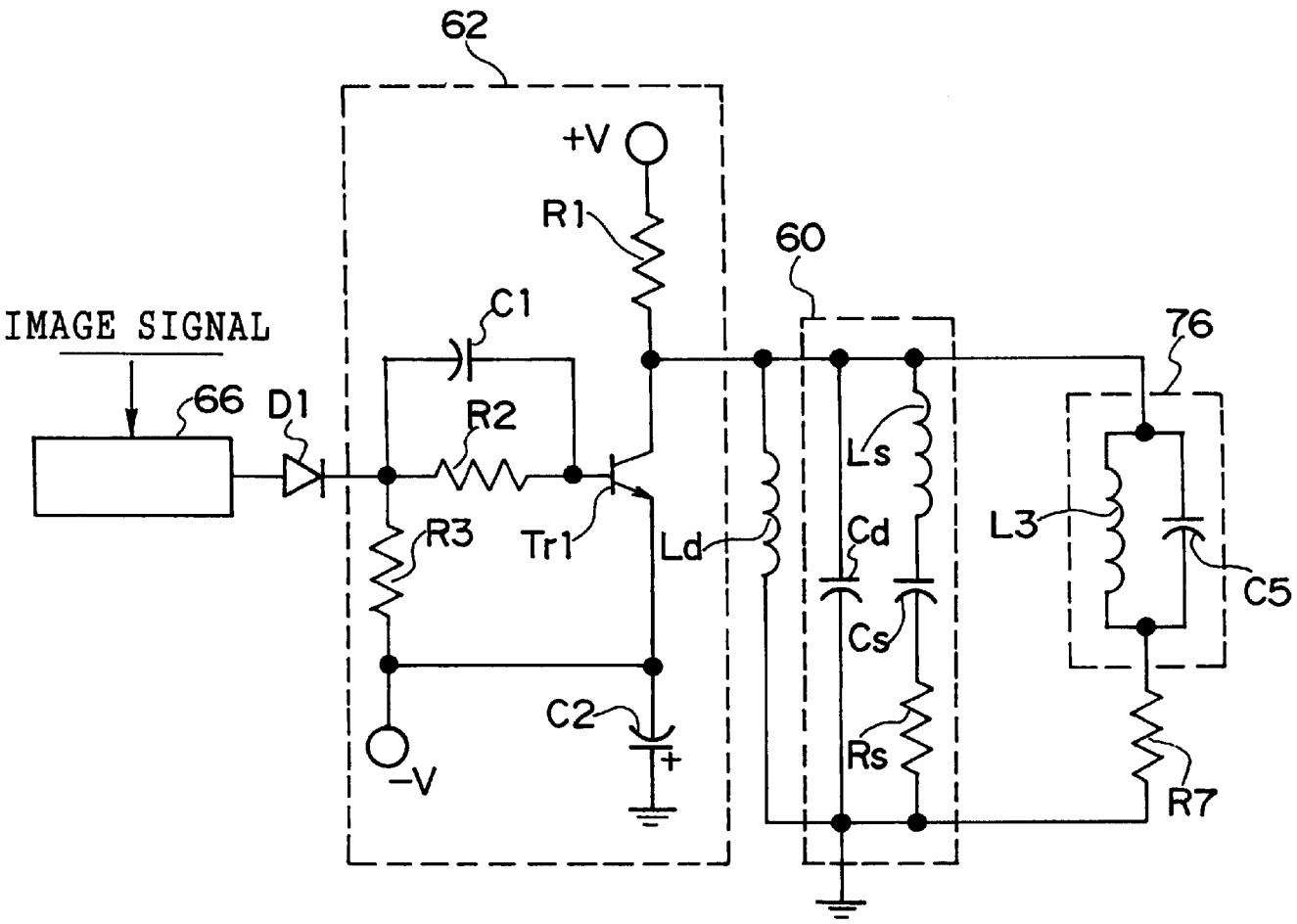
FIG. 1 is a schematic diagram of piezoelectric element and its driver and peripheral circuits in an inkjet injector in accordance with the fourth embodiment of the present invention, in which LC circuits regulate the fluctuating capacitance due to the printing pattern.

Now referring to FIG. 1, in the present embodiment, a series connection of an LC circuit 76 including an inductance L3 connected in parallel to a capacitor C5, and a resistor R7 is inserted in parallel across the fixed inductance Ld, which is connected in parallel to the degenerated equivalent circuit 60 for oscillators in the preceding embodiments. The resistor R7 is served as an amplitude limiting resistor. The inductance L3 and capacitor C5 correspond to the adjusting means of the present invention as well as the LC circuit of the present invention.

Now the function of the present preferred embodiment will be described below in detail.

In the present embodiment, for the fixed inductance. Ld, the value L with respect to the capacitance (Cd) of the capacitor Cd in the degenerated equivalent circuit 60 of simultaneously driven oscillators, may be given by $f=1/(2\pi\sqrt{L\cdot Cd})$, where f is the characteristic oscillation frequency of an oscillator or the driving frequency of an oscillator when the degenerated equivalent circuit 60 of simultaneously driven oscillators is 50% of the simultaneously driven maximum number.

The capacitance C of the capacitor in the LC circuit 76 is set to 50% value of the fluctuating capacitance in the degenerated equivalent circuit 60 of simultaneously driven oscillators, then with respect to this C, L may be set so as to be the value given by $f=1/(2\pi\sqrt{L\cdot C})$.

The LC circuit 76 is operative so as to compensate for the lacking complex component with respect to the driving frequency when the capacitance in the degenerated equivalent circuit 60 for simultaneously driven oscillators is varied in response to a printing pattern.

Figure 8A:
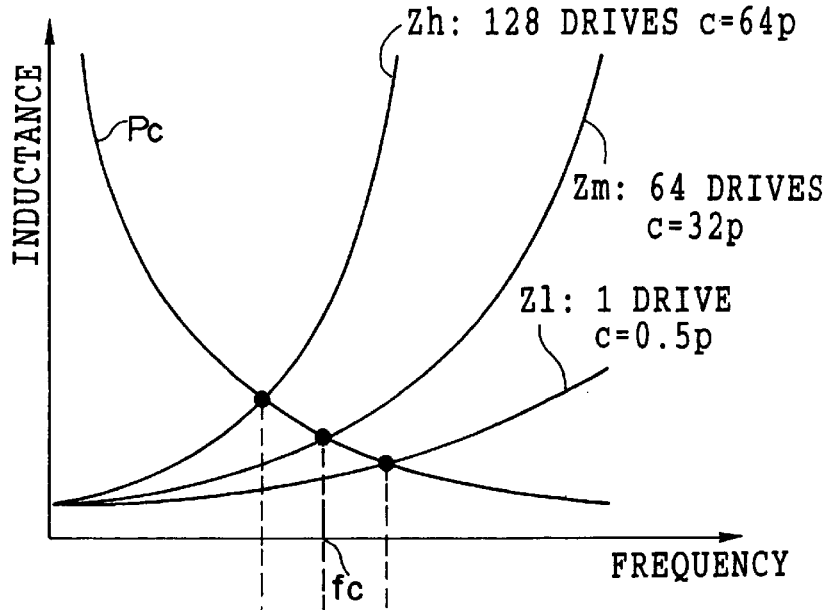
FIGS. 8A and 8B are schematic diagrams illustrating the compensation for complex components lacking with respect to the driving frequency by an LC circuit for regulating the fluctuated capacitance due to the printing pattern.
Figure 8B:
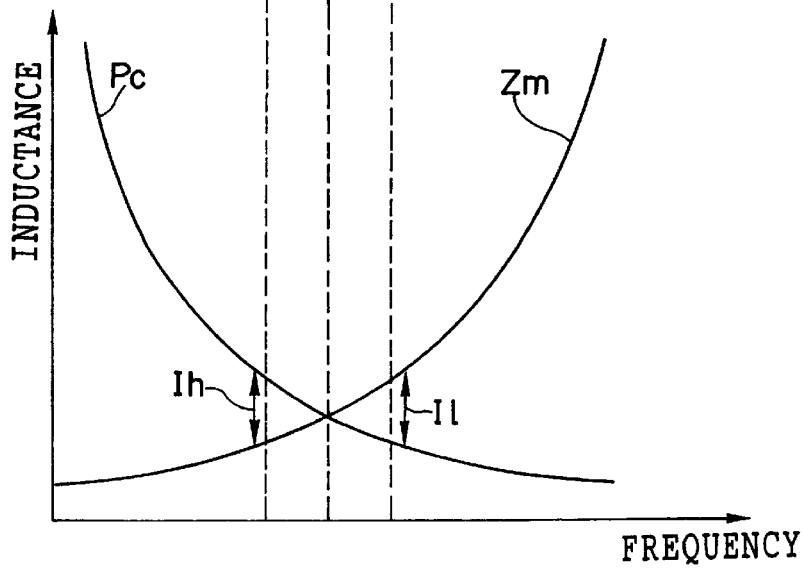

As shown in FIG. 8A, in the TANK circuit including an inductance Ld and capacitor Cd, the characteristics Pc of C component ($1/j\omega C$) will be such that the capacitance decreases along with the increase of frequency, while the characteristics of L component ($j\omega C$) will be such that the inductance increases along with the increase of frequency. In FIGS. 8A and 8B, characteristics Z1 designates to the L component if the number of simultaneously driven oscillators is 1, Zm to the L component if half of oscillators are driven, and Zh to the L component if all oscillators are driven, respectively. Here, the frequency varies according to the number of simultaneously driven oscillators: C component will be 0.5 p if the number of simultaneously driven oscillators is 1, 32 p if half of oscillators are driven, and 64 p if all of oscillators are driven.

In contrast, since in the present embodiment The LC circuit 76 comprised of the inductance L3 and capacitor C5 is connected in parallel, as shown in FIG. 8B, the L component and C component will be the same if half of oscillators are driven, while on the other hand the difference I1 between the characteristics Pc and Zm will be produced and compensated for if the number of simultaneously driven oscillators is 1, and the difference Ih between the characteristics Pc and Zm will be produced and compensated for if all oscillators are driven.

By adding an additional LC circuit 76 in parallel to the LC (TANK) circuit comprised of an oscillator capacitance in the equivalent circuit and a fixed inductance, the fluctuated capacitance up to its complex component will be compensated for and the oscillators will be driven at a constant frequency.

In the present embodiment a resistor R7 is connected in series to the LC circuit 76, which resistor R7 may operate as a limiting resistor. Now the limiting resistor will be described in detail below.

The resistor R7 operating as a limiting resistor is served for holding at a constant amplitude the transferred signal voltage in case of fluctuation of capacitance. More specifically the limiting resistor may hold at a constant amplitude the transferred signal voltage by maintaining the charges in the additional LC circuit to a constant level with respect to the LC circuit comprised of the oscillator capacitance Cd and the fixed inductance Ld. The resistance value of the resistor R7 operating as a limiting resistor with respect to the capacitance C of the capacitor in the LC circuit may be given by $$f=1/(2\pi CR)$$

where f is the characteristic oscillation frequency or the driving frequency of the oscillators. The resistor R7 allows the transit charges in the degenerated equivalent circuit 60 for simultaneously driven oscillators to limit to be equal to that in the fixed inductance Ld, while at the same time it may operate as a CR filter, so that the fluctuation of frequency will not occur.

Figure 9A:
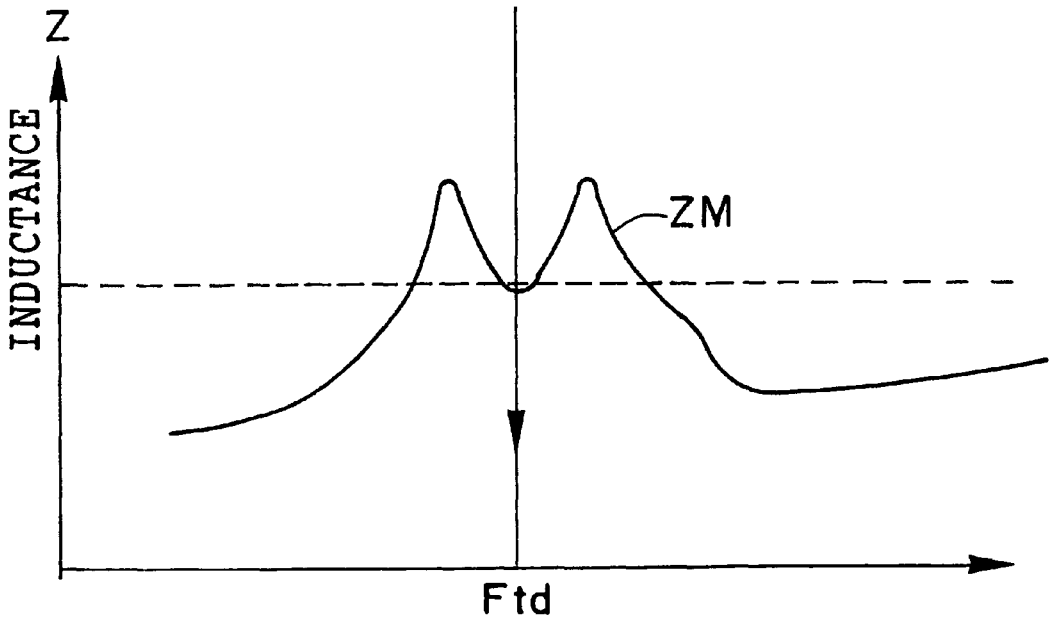
FIGS. 9A and 9B are schematic diagrams of a limiting resistor.
Figure 9B:
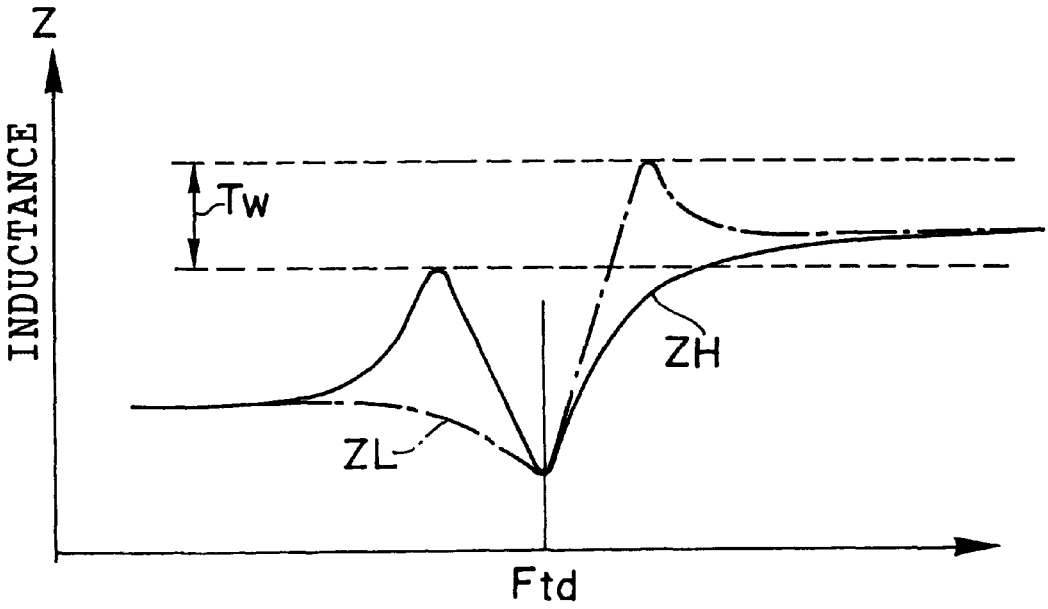

As shown in FIG. 9A, if the number of simultaneously driven oscillators is half (64), the characteristics of fixed inductance Ld will be ZM having two humps along with the fluctuated frequency. In this case the characteristics of resistor R7 is ZL if the number of simultaneously driven oscillators is 1 as shown in FIG. 9B, the characteristics will be ZH if all elements (128) are driven. Center frequency Ftd in case of one half of simultaneously driven oscillators will be coincided and minimized. However, the amplitude of the maximum possible value of characteristics ZL and that of ZH has a width Tw. By selecting such a resistance value that can minimize (or for example coincide with) the width Tw, the transit charges of the degenerated equivalent circuit 60 and of the fixed inductance Ld becomes equal so that the fluctuation of frequency will not occur (the resistor functions as a CR filter).

Consequently, the resistor R7 operating as a limiting resistor may hold the voltage amplitude of transferred signal at a constant level in case of fluctuated capacitance.

Fifth Embodiment

The fifth embodiment of the present invention make use of the principle in which the parallel connected inductance may be degenerated. More specifically, although in the preceding fourth embodiment the LC circuit 76 is added, the inductance L3 shown in FIG. 1, which is connected in parallel to the fixed inductance Ld, can be degenerated to one unique inductance. By using this, in the present embodiment, the number of parts constituting the LC circuit of the fourth embodiment may be reduced. The present embodiment has the identical configuration as the preceding embodiments, the similar members are designated to the identical reference numbers and the detailed description of the parts already described in the preceding embodiments will be omitted.

Figure 10:
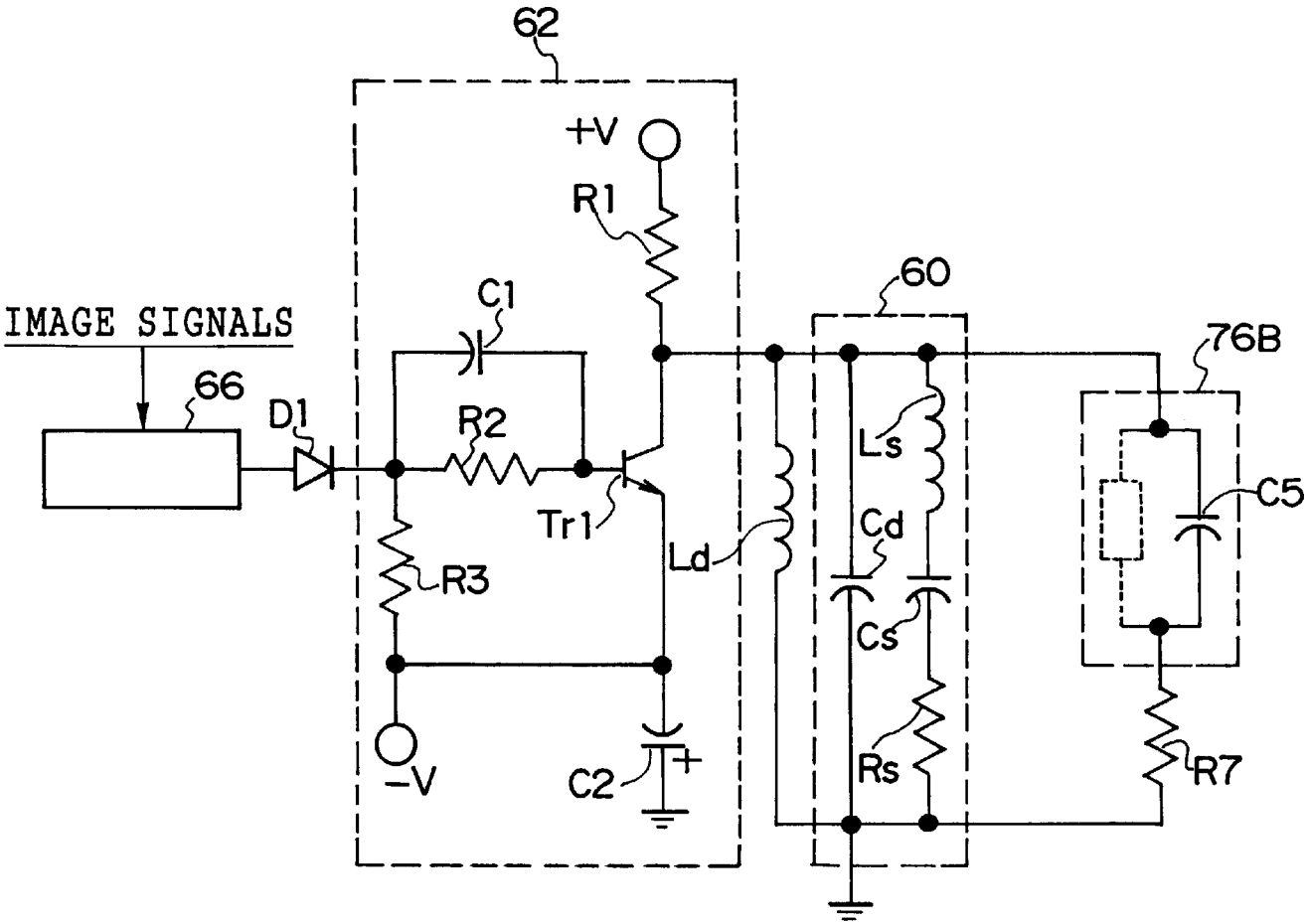
FIG. 10 is a schematic diagram of a piezoelectric element 7 and its driver and peripheral circuits in an inkjet injector in accordance with the fifth embodiment of the present invention, in which the capacitance fluctuation due to printing pattern may be regulated by a degenerated inductance.

In the present embodiment, as shown in FIG. 10, a circuit 76B constituted only of a capacitor C5 is connected in series to the resistor R7, with the inductance L3 removed from the LC circuit 76 of FIG. 1 comprising the parallel connection of the inductance L3 and capacitor C5. In other words, a CR circuit is formed by degenerating the inductance L3 of the LC circuit 76 in FIG. 1 (the position of inductance L3 shown in FIG. 1 is indicated by a dotted line in FIG. 10). The inductance L3 and resistor R7 correspond to the adjusting means as well as RC circuit in the principle of present invention.

Two inductances shown in FIG. 1 connected in parallel may be degenerated to have only one fixed inductance. This may be equal to the inductance value tuned to the capacitance at the time when the maximum possible oscillators are simultaneously driven. Therefore this configuration apparently equals to the addition of a CR circuit along with the fluctuated capacitance.

The present embodiment allows one inductance to be reduced, without degradation of functionality, to reduce the number of elements used.

Figure 11A:
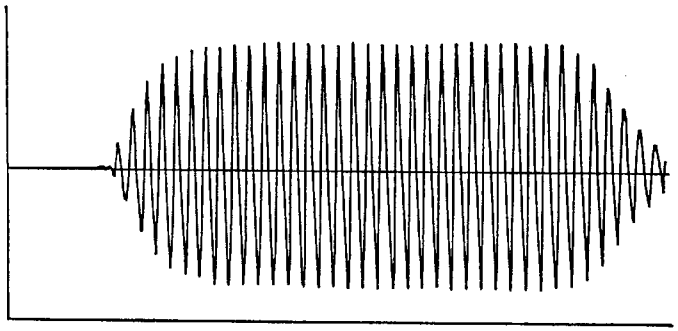
FIGS. 11A, 11B and 11C are results of simulation of simultaneous carrying out the third, fourth and fifth embodiments of the present invention, illustrating the voltage waveforms in an equivalent resistor.
Figure 11B:
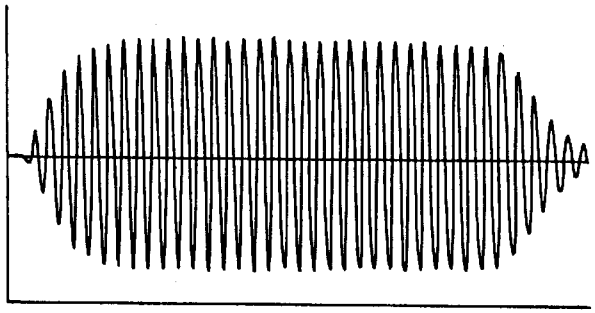
Figure 11C:
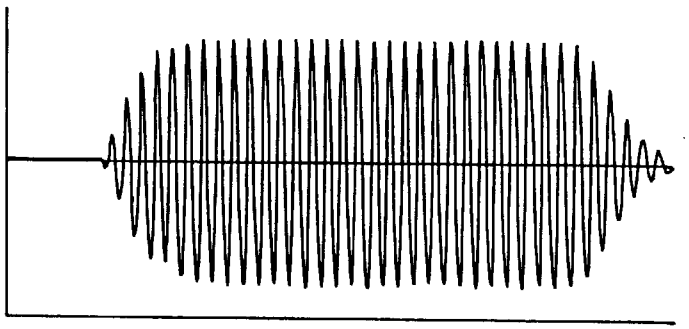

Verification:

FIGS. 11A, 11B and 11C show a result of simulation of simultaneous carrying out of the third, fourth and fifth embodiments as described above. The points indicated in the FIGS. 11A, 11B and 11C are voltage waveforms at the acoustic equivalent resistance within an oscillator equivalent circuit.

FIG. 11A shows voltage waveform when driving one oscillator as case 1; FIG. 11B shows voltage waveform when simultaneously driving 64 oscillators as case 2; FIG. 11C shows voltage waveform when simultaneously driving all 128 oscillators as case 3. As can be appreciated from this figure, it may be confirmed that no significant changes of frequency or amplitude can be noticed, and that a good result can be obtained.

Sixth Embodiment

In this embodiment, controllable quantities are determined by detecting supplied current. The present embodiment has the identical structure to the preceding embodiments, the similar members are designated to the identical reference numbers and the detailed description of the parts already described in the preceding embodiments will be omitted.

The present embodiment is to determine the controllable quantities by detecting current, unlike a preliminary calculation from the printing pattern of voltage for controlling the voltage controlled variable capacitative element in the first and second embodiments, or voltage for controlling the voltage controlled variable inductance element in the third embodiment. If the supply side has a constant voltage characteristics, since the magnitude of load is the product of the number of printing and the capacitance of each respective oscillator, the supplied current from the supplier will be proportional to the printing pattern. By using this the controllable quantities may be determined by detecting the current.

Figure 12:
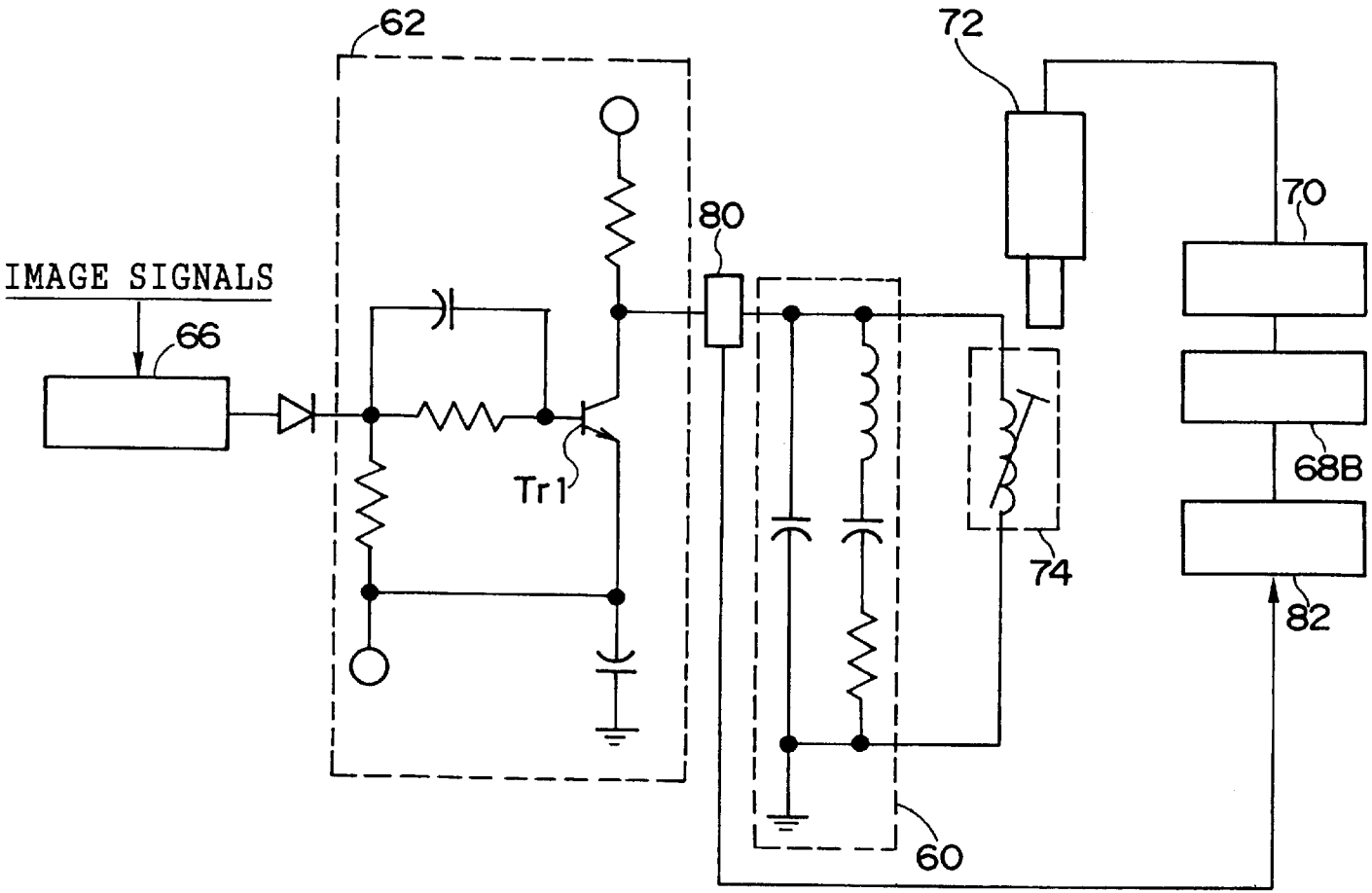
FIG. 12 is a schematic diagram in accordance with the sixth embodiment of the present invention, in which the controllable voltage for a voltage controlled variable capacitative element is determined by current detection.

As shown in FIG. 12, the present embodiment comprises a current detecting sensor 80 such as a Hall element and the like between the oscillator driver circuit 62 and the degenerated equivalent circuit 60. The current detecting sensor 80 is connected to the signal processor 68B through a detector circuit 82, which comprises a current detection amplifier and an ADC (analog-to-digital converter). The signal processor 68B comprises a numerical calculator and a control signal generator.

The current detecting sensor 80 and detector circuit 82 correspond to the power detector means in the principle of the present invention while the signal processor 68B, solenoid driver circuit 70, solenoid 72 correspond to the power controller means in the principle of the present invention.

The current corresponding to the oscillator capacitance fluctuating in response to the printing pattern may be detected by the current detecting sensor 80 such as a Hall element and the like. The Hall element may be replaced with a series resistor. The detected current is amplified and detected in the current detecting amplifier in the detector circuit 82 so as to yield signals appropriate to the counting in the ADC, then is analog-to-digital converted in the ADC. These digital quantities are output to the signal processor 68B, where the numerical process is carried out to determine an inductance value. A variable inductance control signal corresponding to the inductance value determined will be generated and output from the control signal generator. This variable inductance control signal is a core moving signal as described above.

Although in the present embodiment has been described a case of controlling a variable inductance, the present invention is not limited thereto. Rather, a variable capacitance may be controlled instead, as the case of first or second embodiment.

The present embodiment determines the controllable quantities by current detecting, however the controllable quantities may also be determined by voltage detection. In such a case a voltage detection sensor may be used instead of the current detecting sensor 80 shown in FIG. 12. In addition, for the detector circuit 82, a voltage detector amplifier circuit may be used instead of the current detector amplifier. A voltage may be detected rather than a current, so that it may not need to be detected by a series resistor or a Hall element, it may be sufficient that output signals is connected to an ADC (analog-to-digital converter) at an appropriate level. In such a case the configuration like the first or second embodiment above may be used which may control a variable capacitance.

Seventh Embodiment

In an inkjet printer, large amplitude signals are required for the switching signals for supplying sufficient energy to piezoelectric elements to inject ink drops. In order to control injection of ink drops by turning on and off the RF signals, however, RF switches should be used to switch the RF signals amplified by the radio frequency amplifier. To do this, some RF switch devices such as high voltage diodes have to be used (see FIG. 22), switching by RF switches of the RF signals after amplification causes inevitable decrease of energy efficiency even though such RF switches as high voltage diodes and the like are used.

The present embodiment provides a driver circuit which may be used for small amplitude input signal, and which may perform high speed switching without decrease of energy efficiency. The present embodiment has the identical structure to the preceding embodiments, the similar members are designated to the identical reference numbers and the detailed description of the parts already described in the preceding embodiments will be omitted.

Figure 13:
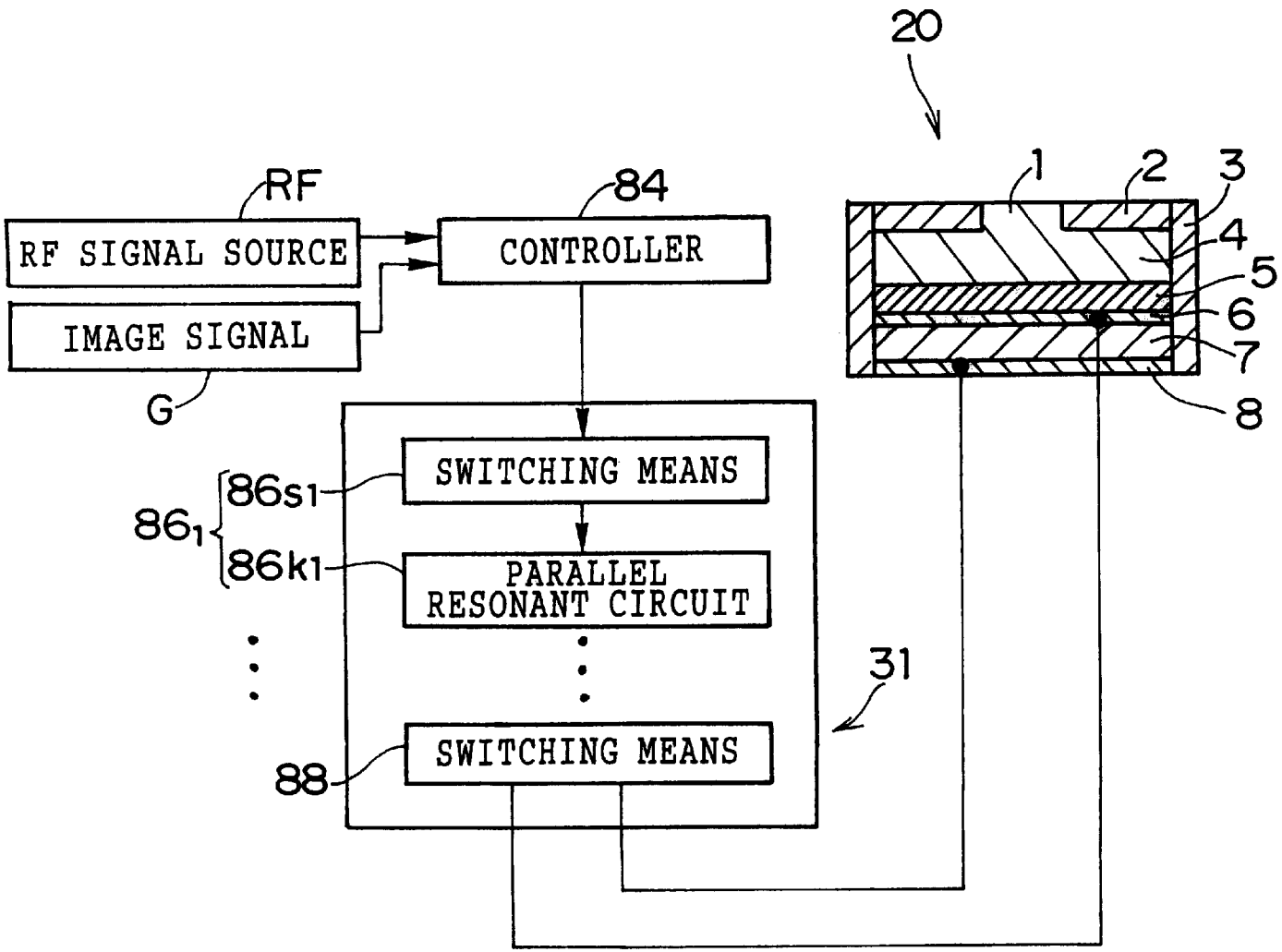
FIG. 13 is a schematic diagram illustrating the ink, carrier particles, and driver circuits in accordance with the preferred embodiment of the present invention.

Now referring to FIG. 13, there is shown a schematic diagram of an ink injector head 20 and its driver circuit 30 of an ink injector apparatus. The ink injector head 20 of an ink injector apparatus in accordance with the present embodiment has the similar structure to that of FIG. 3, the detailed description of the identical members will be omitted. One of output node of the driver circuit 31 is connected to the lower electrode 8, and the other output node of the driver circuit 31 is connected to the upper electrode 6. The input node from the controller processing the RF signals based on the image signals G from the RF signal source RF is connected to the driver circuit 31.

The driver circuit 31 performs switching operation according to the input signals, and comprises a plurality of circuits (n stages) 86*i* including switching means 86*si* (i=1, 2, . . . , n) and a parallel resonant circuit 86*ki*. The output from a circuit 86*i* including switching means 86*si* (i=1, 2, . . . , n) and a parallel resonant circuit 86*ki* is supplied to the succeeding stage j at a sufficient amplitude to drive a switching means 86*sj* in the next stage j (=i+1), by the tuning effect of parallel resonant circuit. After iteratively repeating such stage behavior for a plurality of stages, the circuit 86*n* in the last stage n outputs for driving the switching means 88 to obtain the signals required for driving the piezoelectric element 7. In this embodiment two stages circuitry will be described by way of example.

Although the driver circuit 31 of the present embodiment will be described comprised of a plurality of stages (n stages) of circuit 86*i* including the switching means 86*si* and the parallel resonant circuit 86*ki*, the driver circuit 31 further includes other components included in the driver similar to the above described embodiments.

Figure 14:
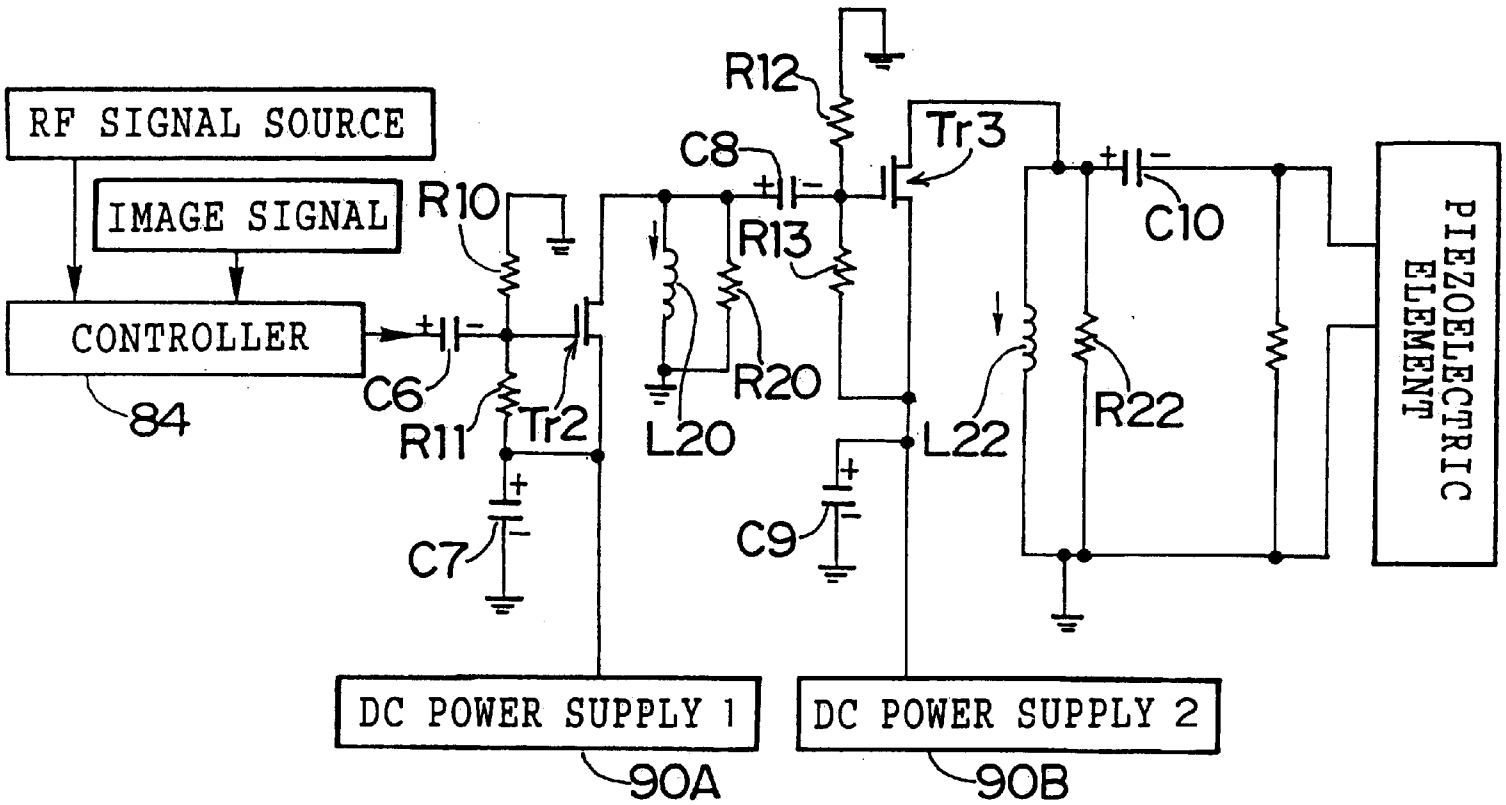
FIG. 14 is a schematic diagram of a driver circuit for. an inkjet printer in accordance with the seventh embodiment of the present invention.

Now referring to FIG. 14 there is shown a circuit diagram from the driver circuit 31 to the piezoelectric element 7. The piezoelectric element 7 is indicated as an equivalent circuit in this figure. The signals from the controller 84 are so-called tone-burst waves, which may turn on and off RF signals at a certain timing, the signals may also be sinusoidal waves oscillating to both positive and negative sides around the ground level, or may be pulses in either positive or negative side. If pulses are used, the combination of a crystal oscillator and a PLL (phase locked loop) for the RF signal source may be suited for compact and low power consumption design.

The signals from the controller 84 is input through the capacitor C6 to the gate of a transistor Tr2, corresponding to the second transistor of the principle of the present invention. The resistors R10 and R11 are used for regulating the input bias to an appropriate level to the transistor Tr2. The source of the transistor Tr2 is applied with negative voltage from the direct current power source 90A. The drain thereof is connected to the gate of the next stage transistor Tr3, the first transistor of the principle of the present invention, through a capacitor C8.

The transistor Tr2 has to perform high speed switching of small amplitude input signal, for which high speed, small input capacitance FETs and the like may be suitable.

Between the transistor Tr2 and the transistor Tr3 an inductance L20 and a resistor R20 are inserted in parallel. These components form a parallel resonant circuit together with the composite capacitance comprised of the output capacitance of the transistor Tr2 and the input capacitance of the transistor Tr3, burst signals having larger amplitude sinusoidal waves tuned to the input signals may be obtained by setting the inductance L20 to the value as given by $f=1/\sqrt{L20 \cdot C_{c1}}$, based on the frequency f of the input RF signals and the composite capacitance $C_{c1}$.

The resistor R20 is used for controlling the sharpness Q, i.e., wave-shaping of the rising and falling edges of RF signals in the burst and preferably $1<Q<2$. A capacitor C7 for charging and discharging is connected to the junction between the source of transistor Tr2 and the ground to supply necessary charges for high speed switching.

The output from the drain of transistor Tr2 is input to the gate of transistor Tr3 through the capacitor C8. The resistors R12 and R13 are used for regulating the input bias to the transistor Tr3 to an appropriate level.

To the source of transistor Tr3 larger negative voltage is to be applied from the DC power supply 90B. For the transistor Tr3, high speed high power FETs with larger input capacitance than the transistor Tr2 will be suitable. To drive a transistor of large input capacitance, larger input signals are required. The tuning effect of parallel tuning circuit as described above formed by the L20, R20, and composite capacitance $C_{c1}$ allows to supply a sufficient amplitude to drive the transistor Tr3. A capacitor C9 for charging and discharging is connected to the junction between the source of transistor Tr3 and the ground to supply necessary charges for high speed switching.

The drain of transistor Tr3 is connected to the piezoelectric element via an inductance L22 and a resistor R22 in parallel and a capacitor C10 in series. The inductance L22 forms a parallel resonant circuit with respect to the composite capacitance made of the output capacitance of transistor Tr3 and the piezoelectric element capacitance so as to increase the driving voltage of piezoelectric element. The resistor R22 is used for controlling the sharpness Q, i.e., wave-shaping of the rising and falling edges of RF signals in the burst and preferably $1<Q<2$.

The capacitor C10 is used for fail-safe measure for preventing the direct current component from being applied to the piezoelectric elements.

In the present embodiment, by sequentially connecting parallel tuning circuits each driving a small capacity transistor, a larger capacity transistor may be readily driven. In other words signals sufficient to drive the piezoelectric element 7 may be obtained from small power source.

The seventh embodiment may be carried out combined with any one of the above-mentioned first through sixth embodiment. In order to combine it with the first through sixth embodiments, the transistor Tr1 in the first through sixth embodiments may be formed by a plurality of stages. Thus the switching part needs to be formed by a plurality of switching element stages.

Eighth Embodiment

Figure 15:
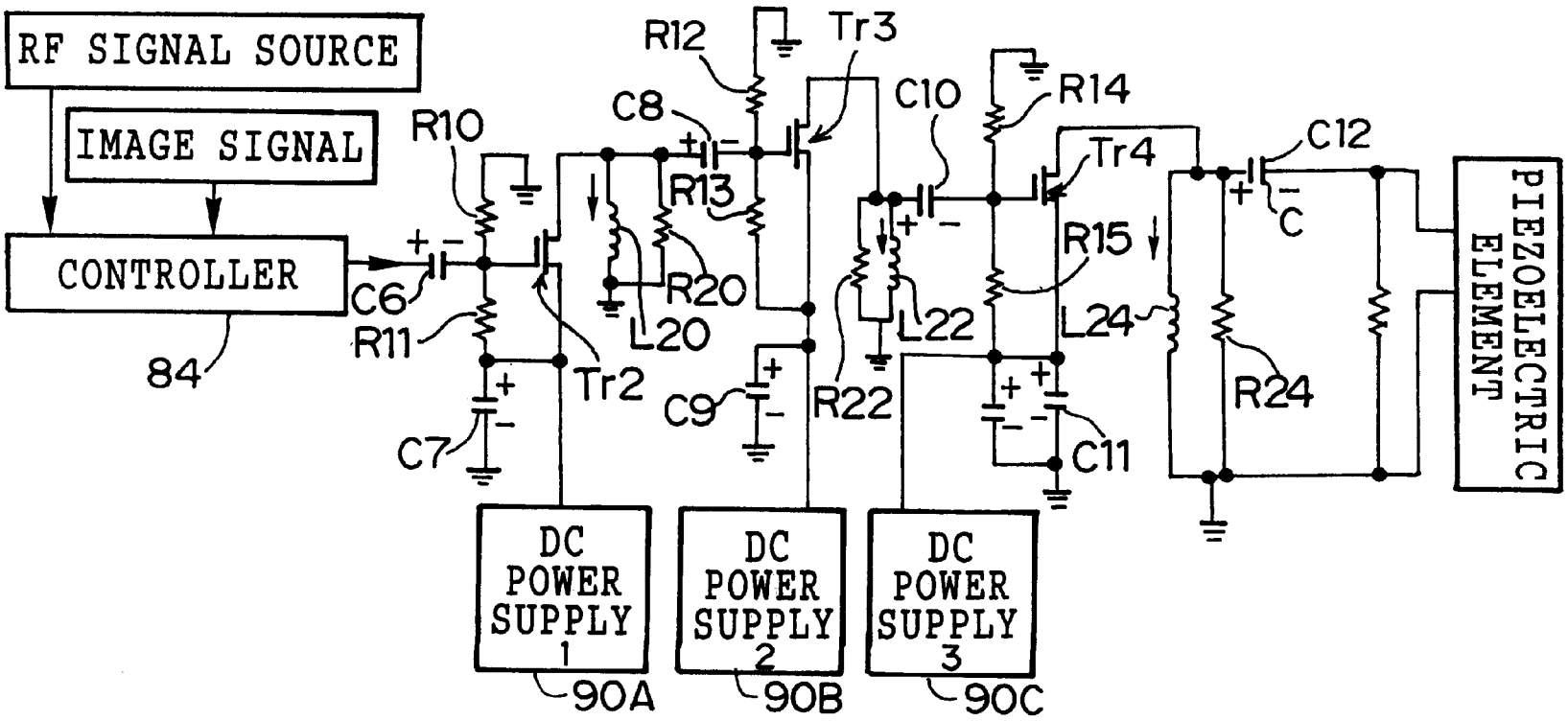
FIG. 15 is a schematic diagram of a driver circuit for an inkjet printer in accordance with the eighth embodiment of the present invention.

Now referring to FIG. 15, there is shown a circuit diagram from the driver circuit 30 to the piezoelectric element in accordance with the present embodiment. The signals from the controller are tone-bursts similar to that of the seventh embodiment.

The signals from the controller 84 are input to the gate of transistor Tr2 through a capacitor C6. The resistors R10, R11 are used for regulating the input bias to the transistor Tr2 to an appropriate level. To the source of transistor Tr2 negative voltage is applied from the DC power supply 90A. The drain of transistor Tr2 is connected to the gate of next stage transistor Tr3 through the capacitor C8.

The transistor Tr2 has to perform high speed switching of a small amplitude input signal, for which high speed, small input capacitance FETs and the like may be suitable.

Between the transistor Tr2 and the transistor Tr3, an inductance L20 and a resistor R20 are inserted in parallel. These components form a parallel resonant circuit together with the composite capacitance comprised of the output capacitance of the transistor Tr2 and the input capacitance of the transistor Tr3. Similar to the seventh embodiment, burst signals having larger amplitude sinusoidal waves tuned to the input signals may be obtained, based on the frequency f of the input RF signals and the composite capacitance $C_{c1}$, by setting the inductance L20 to the value as given by the equation cited above.

The resistor R20 is used for controlling the sharpness Q, i.e., wave-shaping of the rising and falling edges of RF signals in the burst and preferably $1<Q<2$. A capacitor C7 for charging and discharging is connected to the junction between the source of transistor Tr2 and the ground to supply necessary charges for high speed switching.

The output from the drain of the transistor Tr2 is input to the gate of the transistor Tr3 through the capacitor C8. The resistors R12 and R13 are used for regulating the input bias to the transistor Tr3 to an appropriate level.

To the source of the transistor Tr3 larger negative voltage is to be applied from the DC power supply 90B. For the transistor Tr3, high speed high power FETs with larger input capacitance than the transistor Tr2 will be suitable.

To drive a transistor of large input capacitance, larger input signals are required. The tuning effect of parallel tuning circuit as described above formed by the L20, R20, and composite capacitance $C_{c1}$ allows to supply a sufficient amplitude to drive the transistor Tr3. A capacitor C9 for charging and discharging is connected to the junction between the source of transistor Tr3 and the ground to supply necessary charges for high speed switching.

The drain of the transistor Tr3 is connected to a transistor Tr4 via an inductance L22 and a resistor R22 in parallel and a capacitor C10 in series. The inductance L22 forms a parallel resonant circuit with respect to the composite capacitance made of the output capacitance of the transistor Tr3 and the input capacitance of the transistor Tr4, allowing burst signals by larger amplitude sinusoidal waves tuned to the input signals to be obtained. The resistor R22 is used for controlling the sharpness Q, i.e., wave-shaping of the rising and falling edges of RF signals in the burst and preferably 1<Q<2. Furthermore a capacitor C9 for charging and discharging is connected to the junction between the source of the transistor Tr3 and the ground to. supply necessary charges for high speed switching.

The output from the drain of transistor Tr3 is input to the gate of the transistor Tr4 through the capacitor C10. The resistors R14 and R15 are used for regulating the input bias to the transistor Tr4 to an appropriate level.

To the source of the transistor Tr4 larger negative voltage from the DC power supply 90C than the power supply 90B is applied. It should be noted that the voltage from the power supply 90C may be equal to that from the power supply 90B. In such a case a power supply may be shared. In any case, high speed high power FETs with larger input capacitance than the transistor Tr2 will be suitable for the transistor Tr4. To drive a transistor of large input capacitance, larger input signals are required. The tuning effect of parallel tuning circuit as described above formed by the L22, R22, and composite capacitance allows to supply a sufficient amplitude to drive the transistor Tr4. A capacitor C11 for charging and discharging is connected to the junction between the source of the transistor Tr4 and the ground to supply necessary charges for high speed switching.

The drain of the transistor Tr4 is connected to the piezoelectric element via an inductance L24 and a resistor R24 in parallel and a capacitor C12 in series. The inductance L24 forms an RLC parallel resonant circuit with respect to the composite capacitance made of the output capacitance of the transistor Tr4 and the piezoelectric element capacitance to increase the driving voltage of the piezoelectric element. The resistor R24 is used for controlling the sharpness Q, i.e., wave-shaping of the rising and falling edges of RF signals in the burst and preferably 1<Q<2.

The capacitor C12 is used for fail-safe measure for preventing the direct current component from being applied to the piezoelectric elements.

In this manner, in the present embodiment, by sequentially connecting parallel tuning circuits each driving a small capacity transistor, a larger capacity transistor may be readily driven. In other words signals sufficient to drive the piezoelectric element 7 may be obtained from small power source.

It is to be noted that more transistors and parallel resonant circuits are connected prior to the piezoelectric elements larger driving voltage may be applied to the piezoelectric elements.

The eighth embodiment may be carried out, similarly to the seventh embodiment above, combined with any one of the above-mentioned first through sixth embodiments.

Ninth Embodiment

Figure 16:
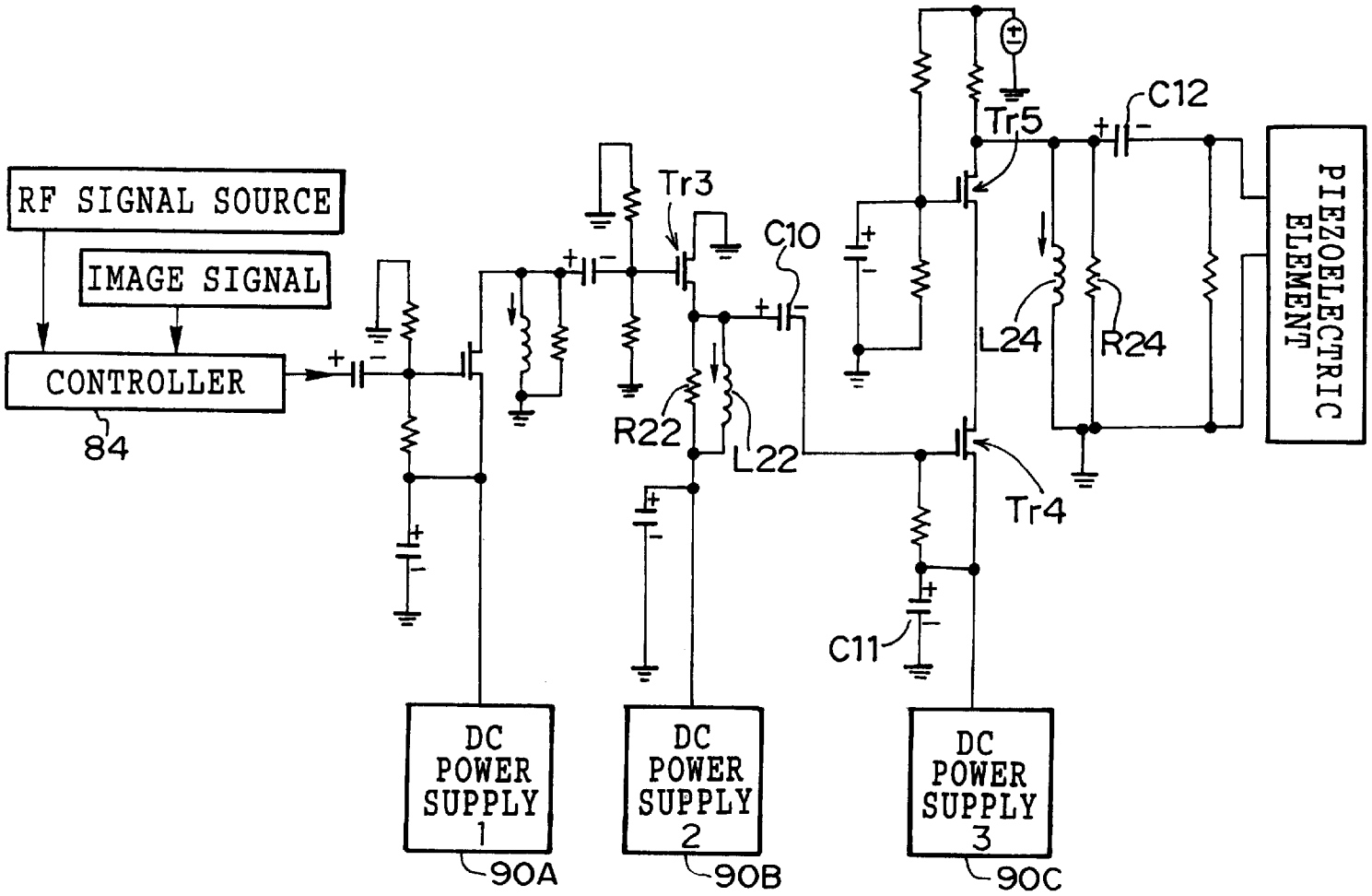
FIG. 16 is a schematic diagram of a driver circuit for an inkjet printer in accordance with the ninth embodiment of the present invention.

Now referring to FIG. 16, there is shown a circuit diagram from the driver circuit 30 to the piezoelectric element in accordance with the present embodiment. The circuitry up to the capacitor C10 is identical to the eighth embodiment.

Signals are connected to the transistor Tr4 through a series capacitor C10. The transistor Tr4 and the transistor Tr5 forms so-called a cascade amplifier. The input capacitance of transistor Tr4 viewed from the input may be decreased by the Mirror effect. This allows the transistor Tr4 to be readily driven. The inductance L22 forms a parallel resonant circuit with respect to the composite capacitance made of the output capacitance of transistor Tr3 and the input capacitance of cascade amplifier including the transistor Tr4, allowing burst signals by larger amplitude sinusoidal waves tuned to the input signals to be obtained. The resistor R22 is used for controlling the sharpness Q, i.e., wave-shaping of the rising and falling edges of RF signals in the burst and preferably 1<Q<2. Furthermore a capacitor C11 for charging and discharging is connected to the junction between the source of transistor Tr3 and the ground to supply necessary charges for high speed switching.

The drain of the transistor Tr5 is connected to the piezoelectric element via an inductance L24 and a resistor R24 in parallel and a capacitor C12 in series. The inductance L24 forms a parallel resonant circuit with respect to the composite capacitance made of the output capacitance of the transistor Tr5 and the piezoelectric element capacitance so as to increase the driving voltage of piezoelectric element. The resistor R24 is used for controlling the sharpness Q, i.e., wave-shaping of the rising and falling edges of RF signals in the burst and preferably 1<Q<2.

The capacitor C12 is used for fail-safe measure for preventing the direct current component from being applied to the piezoelectric elements.

It is to be noted that more transistors and parallel resonant circuits are connected prior to the piezoelectric elements larger driving voltage may be applied to the piezoelectric elements.

As can be appreciated from the above description, the present embodiment may combine switching means and parallel resonant circuits in multiple stage capacitance connection to perform sequential switching of larger power switching means to obtain output sufficient to drive piezoelectric elements connected to the output node.

Although in the seventh through ninth embodiments respective parallel resonant circuit is tuned to the input signals, this is not necessarily required. For example, it is possible to set the resonant frequency twice of the frequency of input signals to obtain output of higher frequency.

The ninth embodiment may be carried out, similarly to the seventh embodiment above, combined with any one of the above-mentioned first through sixth embodiments.

Tenth Embodiment

In the present embodiment, in order to accelerate printing speed, RF signals amplified in the RF signal amplifier RFA should be switched for control switching of a plurality of oscillators in response to printing data. RF switching elements such as high-voltage diode and varactor have to be used (see FIG. 22). However, switching by RF switches of the RF signals after amplification causes inevitable problems, such as decrease of energy efficiency and degradation of isolation between column banks, even though such RF switches as high voltage diodes and the like are used.

The present embodiment is to facilitate switching of high frequency signal without the need for any high voltage components. More specifically, in contrast to the preceding embodiments in which RF signals are amplified prior to switching, in the present embodiment RF signals are switched prior to amplifying. The present embodiment has the identical structure to the preceding embodiments, the similar members are designated to the identical reference numbers and the detailed description of the parts already described in the preceding embodiments will be omitted.

Figure 17:
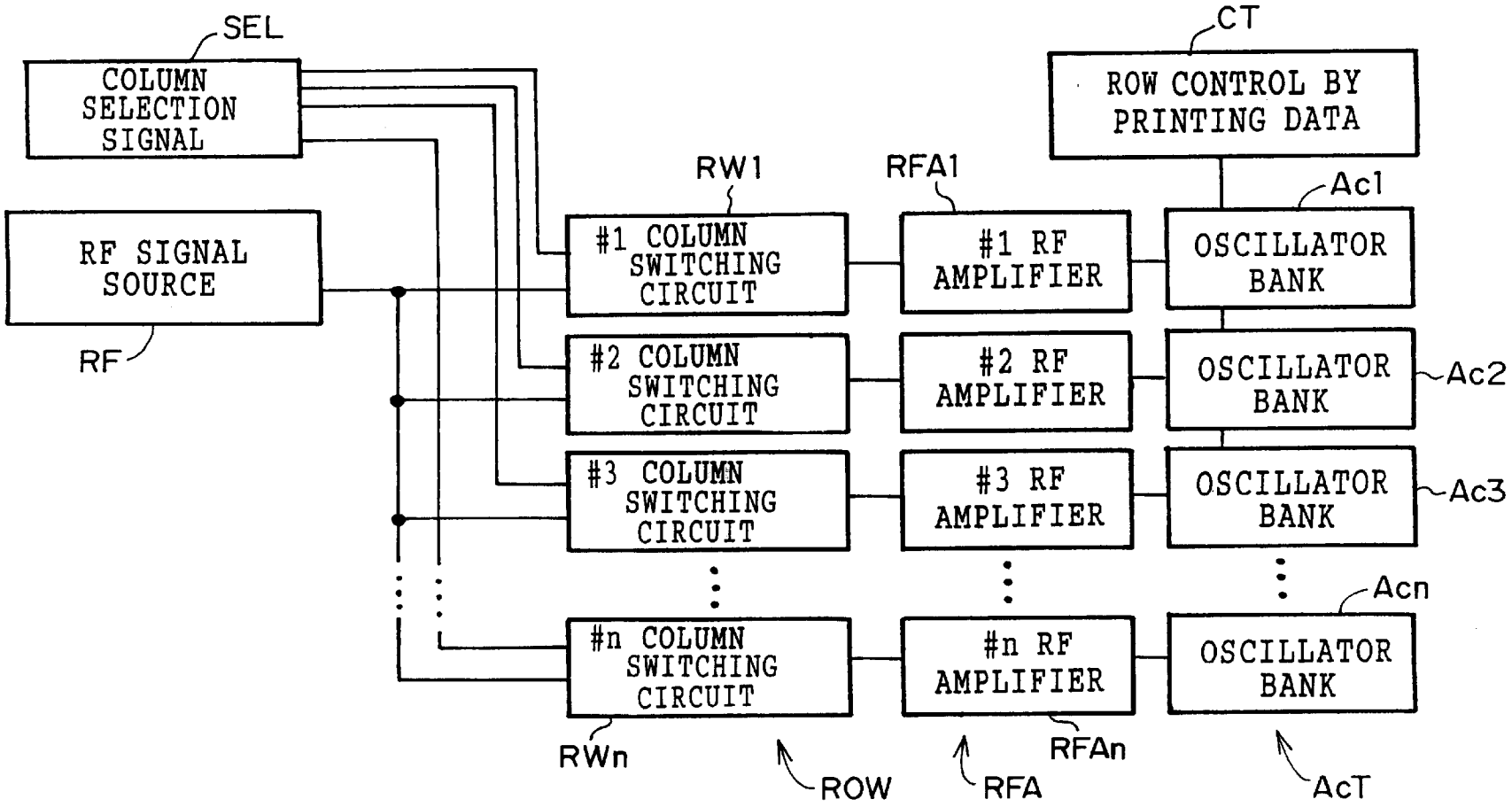
FIG. 17 is a schematic diagram of a driver circuit for an inkjet printer in accordance with the tenth embodiment of the present invention.

Now referring to FIG. 17, there is shown a schematic diagram of a driver circuit for an inkjet printer in accordance with the present embodiment of the present invention.

RF signals generated in an RF signal source RF such as a PLL circuit, will be low voltage signals such as TTL level and CMOS level signals, which will be input to column switching circuits ROW (any one of RW1 to RWn). In the columns switching circuits ROW, only the circuit (any one of RW1 to RWn) selected by the column selector signal SEL among the column switching circuits RW1 to RWn passes RF signals to the high frequency amplifier RFA (any one of RFA1 to RFAn) corresponding to the selected row switching circuit RW1 to RWn to amplify the RF signal to apply RF signals to a column bank of oscillator groups AcT (any one of Ac1 to Acn).

In this configuration, in combination with the row selected by the row selector circuit CT controlled by the printing data, a piezoelectric element 7 for injecting ink is selected to print an image corresponding to the printing data.

The column switching circuits RW in the present embodiment correspond to the switching means in accordance with the present invention. The row selector circuits CT correspond to the driver means. The high frequency amplifier circuit RFA corresponds to the amplifier means in accordance with the present invention. The column of oscillators corresponds to the column bank of piezoelectric elements in accordance with the present invention. The columns of oscillators comprised of oscillator columns AcT (Ac1 to Acn) correspond to the piezoelectric elements groups in accordance with the present invention.

Figure 18:
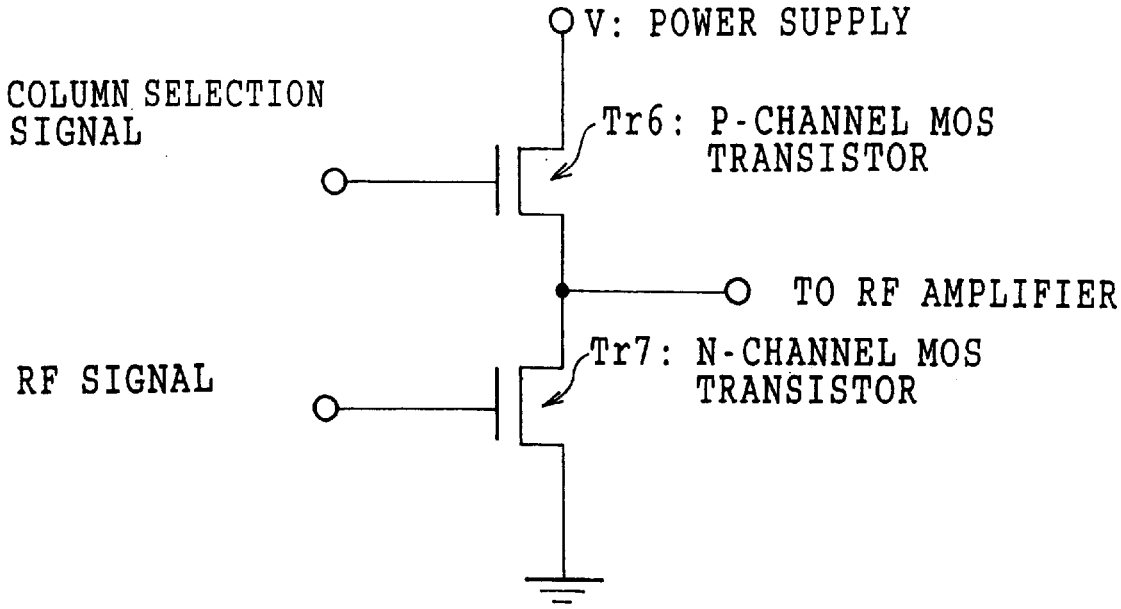
FIG. 18 is a circuit diagram of one channel of RF switch (column selector circuit) in accordance with the tenth embodiment of the present invention.

Now the column selector circuit when using a switching amplifier for high frequency amplifier circuit will be described in detail below. As shown in FIG. 18, a column selector circuit may configure by a P-channel MOS transistor Tr6 and an N-channel MOS transistor Tr7. The "off" output voltage of MOS transistors may be adjusted by altering the parameters (such as on-resistance) for MOS transistors to set the "off" output voltage lower than the threshold voltage level Vth (see FIG. 20C) of high frequency amplifier switching circuit. This prevents erroneous operation of oscillators when MOS transistors are off.

The N-channel MOS transistor Tr7 corresponds to the amplifying transistor in accordance with the present invention. The P-channel MOS transistor Tr6 corresponds to the switching transistor in accordance with the present invention.

Figure 19:
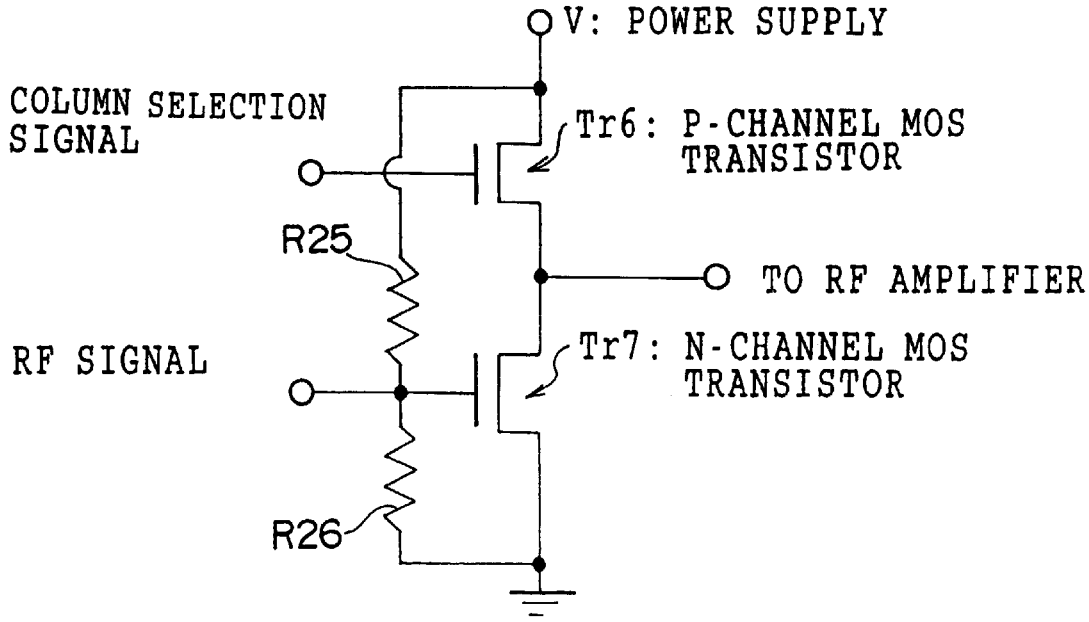
FIG. 19 is a circuit diagram of one channel of RF switch (column selector circuit) in accordance with the tenth embodiment of the present invention, for regulating off output voltage by adjusting a resistor.

As another example of adjusting off output voltage in the column selector circuit, as shown in FIG. 19, resistors R25 and R26 may be inserted to the gate of the N-channel MOS transistor Tr7. More specifically one end of the resistor R25 is connected to the power supply V and the other end is connected to the gate of the N-channel MOS transistor Tr7. One end of the resistor R26 is grounded and the other end is connected to the gate of N-channel MOS transistor Tr7. In this manner the off output voltage of the MOS transistors may be adjustable. The resistors R25 and R26 correspond to the setting means in accordance with the present invention.

The selector circuit as described above will operate properly in this configuration if the drive signals for row and column are swapped on.

Figure 20A:
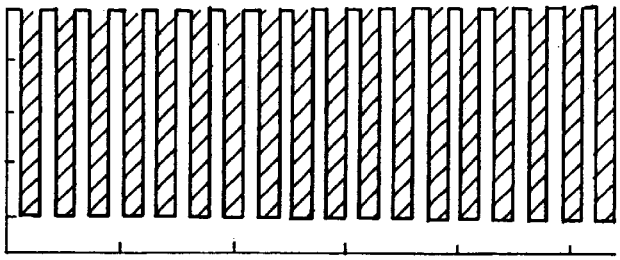
FIGS. 20A, 20B and 20C are signal waveforms in a driver circuit in accordance with the tenth embodiment of the present invention.
Figure 20B:
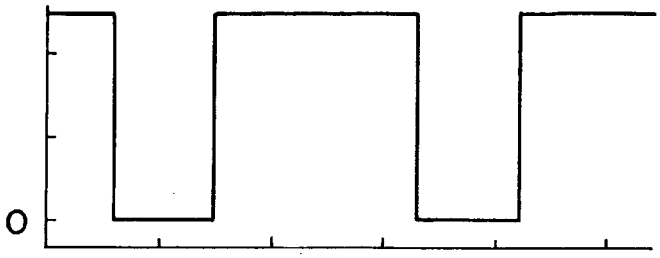
Figure 20C:
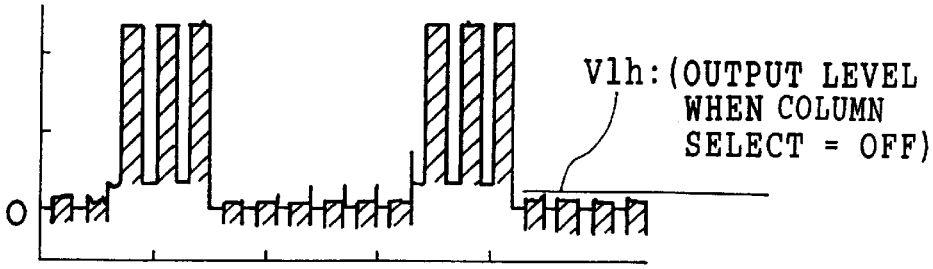
Figure 21:
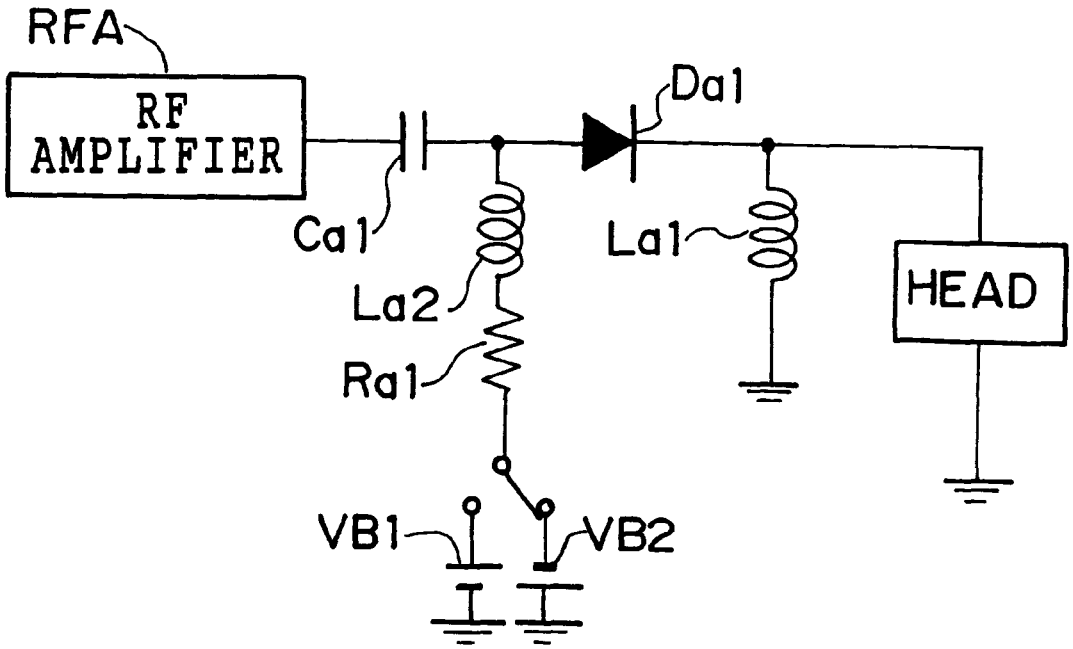
FIG. 21 PRIOR ART
FIG. 21 is a circuit diagram of RF switch using a diode in the Prior Art.

Now referring to FIGS. 20A, 20B and 20C, there is shown signal waveforms in the driver circuits. RF signals shown in FIG. 20A are signal output from the RF signal source RF. Column selector signals shown in FIG. 20B are waveforms for one channel among column selector signals SEL as shown in FIG. 17. Signals shown in FIG. 20C are output waveforms from the column switching circuits RWn as shown in FIG. 17.

In this configuration according to the present embodiment, signal voltage applied to the RF switches may be suppressed to lower level, allowing high frequency switching without the need for high voltage components for the RF switching elements such as PIN diodes and varactors.

Since RF signals of small amplitude are switched, the attenuation of signal in the RF switches can be reduced and the high frequency switching circuits may readily become compact.

Since the signal amplitude is small when switching, the crosstalk to the other signal lines may be reduced, and the improved isolation between column banks may prevent the erroneous operation of ink injection.

By setting the off output voltage of row (or column) selector circuit lower than the threshold level of the high frequency amplifier switching circuit, the erroneous operation (misfire) of the high frequency amplifier switching circuits in the rows (or columns) not currently selected can be prevented.

The configuration using MOS transistors for RF switching circuits to form an RF switch array facilitates integration of RF switching circuits, allowing compact driver circuits.

The tenth embodiment may be carried out combined with any one of the above-mentioned first through ninth embodiments. In order to combine it with the first through sixth embodiments, the output from the controller 66 in the first through sixth embodiments should be conformed to the output from the column selector circuit RW (i.e., column selector circuit RW should be added to the output from the controller 66) and the oscillator driver 62 should be conformed to the RF amplifier RFA. In order to combine with the seventh through ninth embodiments, the output from the controller 84 in the seventh through ninth embodiments should be conformed to the output from the column selector circuit RW (i.e., column selector circuit RW should be added to the output from the controller 84) and the output from the switching means 88 (Tr2 to Tr5) in the seventh through ninth embodiments should be conformed to the RF amplifier RFA (i.e., RF amplifier RFA should be added to the output from the switching means 88). When using switching means 88 (Tr2 to Tr5) as amplifiers, the switching means may be used instead of amplifier RFA.

Although the present invention has been made with respect to an inkjet recording apparatus having a plurality of ink injection mechanisms arranged in a row to enable printing of multiple dots at the same time for accelerate the printing speed, it should be understood that the present invention is not limited thereto, and it can be used in an apparatus which make use of a plurality of energy transducer means arranged in certain configuration.

The present invention is most effective in an inkjet recording apparatus for recording images by generating supersonic waves by using piezoelectric elements to inject liquid ink drops and to adhere ink drops on a recording medium.

In accordance with the present invention, a switching means provided between the supply of AC signals and an amplifier means allows the power of signals consumed by the switching means to be reduced, without the need for high voltage elements in the switching means. The present invention is also effective in the reduction of signal attenuation in the switching means as well as in the realization of compact amplifier such as high frequency amplifier circuits.

Since the adjusting means adjusts the resonant frequency in response to the capacitive load fluctuating according to the number of simultaneously driven piezoelectric elements to set the resonant frequency to a predetermined value, the energy at a constant predetermined frequency may be effectively supplied if the capacitive load fluctuates by the shift of the number of driven piezoelectric elements.

By combining the switching means with the parallel resonant circuit, capacitive connecting a number of stages thereof, and sequentially switching larger and higher powered switching means, the output sufficient to drive piezoelectric elements connected to the output node can be obtained from the burst wave input signals of lower voltage.

The foregoing description of the preferred embodiment of the present invention has been presented for purposes of illustration and description. It is not intended to be exhaustive or to limit the present invention to the precise form disclosed, and modifications and variations are possible in light of the above teachings or may be acquired from practice of the present invention. The embodiment chosen and described in order to explain the principles of the present invention and its practical application to enable one skilled in the art to utilize the present invention in various embodiments and with various modifications as are, suited to the particular use contemplated. It is intended that the scope of the present invention be defined by the claims appended hereto, and their equivalents.

What is claimed is:

1. A driving device for an inkjet recording apparatus for supplying AC signals to a plurality of piezoelectric elements for injecting liquid ink from at least one of said piezoelectric elements to form an image, comprising:

switching means for switching said AC signals for ejecting liquid ink by using selecting signals for selecting piezoelectric elements to be supplied with said AC signals to start ejection of said ink, amplifier means connected to said piezoelectric elements for amplifying said AC signals, and adjusting means for adjusting the resonant frequency in response to the fluctuation of capacitive load of said plurality of piezoelectric elements to regulate the resonant frequency to a predetermined value, wherein said switching means and said amplifier means are connected in series.

2. A driving device for an inkjet recording apparatus for supplying AC signals to a plurality of piezoelectric elements for injecting liquid ink from at least one of said piezoelectric elements to form an image, comprising:

a group of piezoelectric elements including a plurality of piezoelectric element row banks having said plurality of piezoelectric elements arranged in a row for providing a matrix of said plurality of piezoelectric elements;

a plurality of switching means, each provided for a respective corresponding row bank of piezoelectric elements, for switching said AC signals including image signals of said image in order to inject liquid ink from said piezoelectric elements;

a plurality of amplifier means each connected to a respective corresponding row bank of piezoelectric elements and each provided between said group of piezoelectric elements and said switching means, for amplifying said AC signals; and a plurality of adjusting means, each for adjusting the resonant frequency in response to the fluctuation of capacitive load of a respective corresponding row bank of piezoelectric elements to regulate the resonant frequency to a predetermined value.

3. A driving device for an inkjet recording apparatus according to claim 2, further comprising a driver means for driving at least one of said piezoelectric elements for injecting liquid ink from at least one of said piezoelectric elements belonging to said row bank of piezoelectric elements.

4. A driving device for an inkjet recording apparatus according to claim 2, wherein said switching means comprises:

a first transistor and a second transistor, each of which includes a control input terminal, a first terminal and a second terminal, wherein the first terminals of the first and the second transistors are connected in common as output, the second terminal of the first transistor is connected to a first potential, the second terminal of the second transistor is connected to a second potential, the first transistor amplifies the AC signals inputted into the control input terminal, and the second transistor switches to enable or disable the first transistor by selection signals that are inputted into the control input terminal and select the row bank of piezoelectric elements.

5. A driving device for an inkjet recording apparatus according to claim 4, wherein said switching means further comprises setting means connected in parallel to the input of said amplifier transistor for setting the voltage level of input AC signals.

6. A driving device for an inkjet recording apparatus for supplying AC signals to a plurality of piezoelectric elements for injecting liquid ink from at least one of said piezoelectric elements to form an image, comprising:

an inductance connected in parallel to said plurality of piezoelectric elements;

switching control means for controlling the injection of liquid ink by switching on and off the connection between said plurality of piezoelectric elements and said AC signals in response to input signals; and adjusting means for adjusting the resonant frequency in response to the fluctuation of capacitive load of said plurality of piezoelectric elements to regulate the resonant frequency to a predetermined value.

7. A driving device for an inkjet recording apparatus according to claim 6, wherein said adjusting means is a CR circuit of parallel connection of a resistor and a capacitor.

8. A driving device for an inkjet recording apparatus according to claim 6, wherein said adjusting means is a CR circuit of series connection of a resistor and a capacitor.

9. A driving device for an inkjet recording apparatus according to claim 6, wherein said adjusting means comprises a voltage controlling element, and an element controller means for controlling said voltage controlling element in response to said fluctuation of capacitive load.

10. A driving device for an inkjet recording apparatus according to claim 6, wherein said adjusting means comprises a power detector means for detecting the supplied power and a power controller means for regulating said resonant frequency to a predetermined resonant frequency in response to the detected power.

11. A driving device for an inkjet recording apparatus for supplying AC signals to a plurality of piezoelectric elements for injecting liquid ink from at least one of said piezoelectric elements to form an image, comprising:

an inductance connected in parallel to said plurality of piezoelectric elements for forming a tuning resonant circuit;

first switching means for controlling the connection between said plurality of piezoelectric elements and said AC signals;

a resonant circuit connected in parallel to said first switching means;

second switching means for controlling the supply of said AC signals to said resonant circuit; and controller means for controlling the injection of said liquid ink by causing said second switching means to be iteratively repeated on and off in response to the input signal.

12. An inkjet recording apparatus comprising a driving device for supplying AC signals to a plurality of piezoelectric elements for injecting liquid ink from at least one of said piezoelectric elements to form an image, said driving device comprising:

switching means for switching said AC signals for ejecting liquid ink by using selecting signals for selecting piezoelectric elements to be supplied with said AC signals to start ejection of said ink, amplifier means connected to said piezoelectric elements for amplifying said AC signals, wherein said switching means and said amplifier means are connected in series, and adjusting means for adjusting the resonant frequency in response to the fluctuation of capacitive load of said plurality of piezoelectric elements to regulate the resonant frequency to a predetermined value.

13. An inkjet recording apparatus comprising a driving device for supplying AC signals to a plurality of piezoelectric elements for injecting liquid ink from at least one of said piezoelectric elements to form an image, said driving device comprising:

a group of piezoelectric elements including a plurality of piezoelectric element row banks having said plurality of piezoelectric elements arranged in a row for providing a matrix of said plurality of piezoelectric elements;

a plurality of switching means, each provided for a respective corresponding row bank of piezoelectric elements, for switching said AC signals including image signals of said image in order to inject liquid ink from said piezoelectric elements;

a plurality of amplifier means each connected to a respective corresponding row bank of piezoelectric elements and each provided between said group of piezoelectric elements and said switching means, for amplifying said AC signals; and a plurality of adjusting means, each for adjusting the resonant frequency in response to the fluctuation of capacitive load of a respective corresponding row bank of piezoelectric elements to regulate the resonant frequency to a predetermined value.

14. An inkjet recording apparatus comprising a driving device for an inkjet recording apparatus for supplying AC signals to a plurality of piezoelectric elements for injecting liquid ink from at least one of said piezoelectric elements to form an image, said driving device comprising:

an inductance connected in parallel to said plurality of piezoelectric elements;

switching control means for controlling the injection of liquid ink by switching on and off the connection between said plurality of piezoelectric elements and said AC signals in response to input signals; and adjusting means for adjusting the resonant frequency in response to the fluctuation of capacitive load of said plurality of piezoelectric elements to regulate the resonant frequency to a predetermined value.

15. An inkjet recording apparatus comprising a driving device for supplying AC signals to a plurality of piezoelectric elements for injecting liquid ink from at least one of said piezoelectric elements to form an image, said driving device comprising:

an inductance connected in parallel to said plurality of piezoelectric elements for forming a tuning resonant circuit;

first switching means for controlling the connection between said plurality of piezoelectric elements and said AC signals;

a resonant circuit connected in parallel to said first switching means;

second switching means for controlling the supply of said AC signals to said resonant circuit; and controller means for controlling the injection of said liquid ink by causing said second switching means to be iteratively repeated on and off in response to the input signal.

16. A driving device for an inkjet recording apparatus for supplying AC signals to a plurality of piezoelectric elements for injecting liquid ink from at least one of said piezoelectric elements to form an image, comprising:

a group of piezoelectric elements including a plurality of piezoelectric element row banks having said plurality of piezoelectric elements arranged in a row for providing a matrix of said plurality of piezoelectric elements;

a plurality of switching means, each provided for a respective corresponding row bank of piezoelectric elements, for switching said AC signals including image signals of said image in order to inject liquid ink from said piezoelectric elements; and a plurality of amplifier means each connected to a respective corresponding row bank of piezoelectric elements and each provided between said group of piezoelectric elements and said switching means, for amplifying said AC signals, wherein each of the switching means includes a first transistor and a second transistor, each of which includes a control input terminal, a first terminal and a second terminal, wherein the first terminals of the first and the second transistors are connected in common as output, the second terminal of the first transistor is connected to a first potential, the second terminal of the second transistor is connected to a second potential, the first transistor amplifies the AC signals inputted into the control input terminal, and the second transistor switches to enable or disable the first transistor by selection signals that are inputted into the control input terminal and select the row bank of piezoelectric elements.

17. A driving device for an inkjet recording apparatus according to claim 16, wherein said switching means further comprises setting means connected in parallel to the input of said amplifier transistor for setting the voltage level of input AC signals.

* * * * *